US009495913B2

(12) United States Patent
Han

(10) Patent No.: US 9,495,913 B2
(45) Date of Patent: Nov. 15, 2016

(54) ORGANIC LIGHT EMITTING DIODE (OLED) PIXEL, DISPLAY DEVICE INCLUDING THE SAME AND DRIVING METHOD THEREOF

(71) Applicant: Samsung Display Co., Ltd., Yongin, Gyeonggi-do (KR)

(72) Inventor: Sang-Myeon Han, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 109 days.

(21) Appl. No.: 14/619,384

(22) Filed: Feb. 11, 2015

(65) Prior Publication Data

US 2015/0154914 A1 Jun. 4, 2015

Related U.S. Application Data

(62) Division of application No. 13/794,082, filed on Mar. 11, 2013, now Pat. No. 8,982,019.

(30) Foreign Application Priority Data

Nov. 20, 2012 (KR) ..... 10-2012-0131873

(51) Int. Cl.
*G09G 3/32* (2016.01)
*G09G 3/00* (2006.01)

(52) U.S. Cl.
CPC ..... *G09G 3/3291* (2013.01); *G09G 3/003* (2013.01); *G09G 3/3233* (2013.01); (Continued)

(58) Field of Classification Search
CPC ..... G09G 3/3233; G09G 2300/0819; G09G 2300/0861; G09G 2300/0852; G09G 2320/045; G09G 2320/043; G09G 3/3291; G09G 2300/0842; G09G 2310/0262; G09G 2300/0866; G09G 2310/0251; G09G 3/3208; G09G 3/3225; G09G 2320/0223; G09G 2320/0233; G09G 2330/028; G09G 3/3258; G09G 3/32; G09G 3/3266; G09G 2300/043; G09G 2300/0814; G09G 2310/061; G09G 3/00; G09G 3/003; G09G 5/10; G09G 2300/0847; G09G 2300/0876; G09G 2310/0216; G09G 2310/0297; G09G 2320/0261; G09G 2320/0276; G09G 2320/029; G09G 2330/021; G09G 2360/16; G09G 3/30; G09G 5/00; G09G 1/005; G09G 2230/00; G09G 2310/0248; G09G 2310/0254; G09G 2310/0264; G09G 2310/06; G09G 2310/062; G09G 2310/067; G09G 2320/02; G09G 2320/0214; G09G 2320/0219

See application file for complete search history.

(56) References Cited

U.S. PATENT DOCUMENTS

2007/0290954 A1* 12/2007 Miyazawa ..... G09G 3/3233 345/76
2011/0025671 A1* 2/2011 Lee ..... G09G 3/003 345/211
2011/0090213 A1* 4/2011 Han ..... G09G 3/3233 345/213

FOREIGN PATENT DOCUMENTS

KR 10-2008-0095799 A 10/2008
KR 10-2011-0136775 A 12/2011
KR 10-2012-0065139 6/2012

*Primary Examiner* — Md Saiful A Siddiqui
(74) *Attorney, Agent, or Firm* — Knobbe Martens Olson & Bear LLP

(57) ABSTRACT

An organic light emitting diode (OLED) display device includes a plurality of OLED pixels. In one aspect, each pixel respectively includes a first capacitor connected between a data line and a first node, a switching transistor connecting the first node and a second node, a second capacitor connected between the second node and a third node, a driving transistor having a gate electrode connected to the third node and controlling a driving current flowing from a first power source voltage to an OLED, and a reference voltage transistor transmitting a reference voltage to the first node. When a light emitting step occurs in which the OLED emits light, it is simultaneously performed in a plurality of pixels by use of a driving current, the switching transistor is turned off and the reference voltage transistor is turned on such that the reference voltage is transmitted to the first node, and a data voltage corresponding to a scan signal of a gate-on voltage respectively corresponding to a plurality of pixels is stored to the first capacitor. Aspects also include pixel circuits and methods of driving the pixels in the display.

13 Claims, 14 Drawing Sheets

(52) U.S. Cl.
CPC ..... *G09G 2300/0852* (2013.01); *G09G 2300/0861* (2013.01); *G09G 2310/0251* (2013.01); *G09G 2310/06* (2013.01); *G09G 2320/045* (2013.01); *G09G 2330/028* (2013.01)

ORGANIC LIGHT EMITTING DIODE (OLED) PIXEL, DISPLAY DEVICE INCLUDING THE SAME AND DRIVING METHOD THEREOF

CROSS-REFERENCE TO RELATED APPLICATIONS

This application is a divisional of U.S. application Ser. No. 13/794,082, filed on Mar. 11, 2013, which claims priority from Korean Patent Application No. 10-2012-0131873 filed on Nov. 20, 2012 in the Korean Intellectual Property Office, the disclosures of which are incorporated herein by reference in their entireties.

BACKGROUND

1. Field

The disclosed technology relates to a pixel, a display device including the same, and a driving method thereof. More particularly, the disclosed technology relates to a pixel including an organic light emitting diode (OLED), an active matrix type of display device including the pixel, and a driving method thereof.

2. Description of the Related Technology

An organic light emitting diode (OLED) display uses an OLED of which luminance is controlled by a current or a voltage. The organic light emitting diode includes an anode and a cathode layer for forming an electric field, and an organic light emitting material emitting light by the electric field.

Generally, such displays are classified into either a passive matrix OLED (PMOLED) or an active matrix OLED (AMOLED) according to a driving type.

Between them, in view of resolution, contrast, and operational speed, the AMOLED that is selectively turned on for every unit pixel has been primarily used for commercial applications. One frame of the active matrix type display device includes a scan period for image data programming and a light emission period for light emission according to the programmed image data.

Recently, OLED display panels have been produced with increased size and resolution. As the display panel is increased in size and resolution is increased, the time for image data programming increases and driving of the display device becomes more difficult.

Such problems become more severe in displaying a stereoscopic image. When displaying in stereo according to the national television system committee (NTSC) standard, the display device should alternately display 60 frames of a left-eye image and 60 frames of a right-eye image in one second. Thus, such devices require two or more times the driving frequency than that of a d device displaying a non-stereo image.

SUMMARY OF CERTAIN INVENTIVE ASPECTS

The disclosed technology has been made in an effort to provide a pixel having a structure that is appropriate for enlargement of a high-resolution display panel, displaying a stereoscopic image, and that can assure a sufficient aperture ratio, a display device including the pixel, and a driving method of the display device.

An organic light emitting diode (OLED) display device according to an exemplary embodiment of the disclosed technology comprises: a plurality of pixels, each pixel comprising a first capacitor connected between a data line and a first node, a switching transistor connecting the first node and a second node, a second capacitor connected between the second node and a third node, a driving transistor having a gate electrode connected to the third node and configured to control a driving current flowing from a first power source voltage to an organic light emitting diode (OLED), and a reference voltage transistor configured to transmit a reference voltage to the first node, wherein, when a light emitting step in which the OLED emits light is simultaneously performed in a plurality of pixels by a driving current, the switching transistor is turned off and the reference voltage transistor is turned on such that the reference voltage is transmitted to the first node, and a data voltage corresponding to a scan signal of a gate-on voltage respectively corresponding to at least a portion of the pixels is stored in the first capacitor.

Each pixel further comprises an initialization transistor configured to be turned on by an initialization signal of the gate-on voltage and configured to transmit the first power source voltage to the second node.

Each pixel further comprises a compensation transistor configured to be turned on by a compensation control signal of a gate-on voltage so as to connect a gate electrode of the driving transistor and an anode of the organic light emitting diode (OLED).

The reference voltage transistor is configured to be turned on by a scan signal of the gate-on voltage so as to transmit a reference voltage to the first node.

The switching transistor is configured to be turned on by a relay signal of the gate-on voltage so as to connect the first node and the second node.

The switching transistor is configured to be turned on by a compensation control signal of the gate-on voltage so as to connect the first node and the second node.

Each pixel further comprises a second switching transistor configured to be turned on by the scan signal of the gate-on voltage to connect the data line to the first capacitor.

The reference voltage transistor is configured to be turned on by an initialization signal of the gate-on voltage so as to transmit the reference voltage to the first node.

The switching transistor is configured to be turned on by a relay signal of the gate-on voltage so as to connect the first node and the second node.

The switching transistor is configured to be turned on by a compensation control signal of the gate-on voltage so as to connect the first node and the second node.

At least one of the switching transistor, the driving transistor, the reference voltage transistor, the initialization transistor, the compensation transistor, and the second switching transistor may be an oxide thin film transistor (TFT).

A method of driving a display device comprising a plurality of pixels, each pixel comprising a first capacitor connected between a data line and a first node, a switching transistor connecting the first node and a second node, a second capacitor connected between the second node and a third node, a driving transistor having a gate electrode connected to the third node and configured to control a driving current flowing from a first power source voltage to an organic light emitting diode (OLED), and a reference voltage transistor configured to transmit a reference voltage to the first node according to another exemplary embodiment of the disclosed technology comprises: a scan step in which the switching transistor is turned off and the reference voltage transistor is turned on in a scan period of a first frame such that the reference voltage is transmitted to the first node and a data voltage applied to the data line is stored in the first capacitor; and a light emitting step in which the OLED emits light according to a driving current flowing to the driving transistor by a voltage stored in the second capacitor in a light emitting period of the first frame, wherein the voltage stored in the second capacitor depends on the voltage stored in the first capacitor in the scan period of a frame immediately preceding the first frame, and each light emitting step of a plurality of light emitting steps of a plurality of pixels is simultaneously performed, and the scan step and the light emitting step are temporally overlapped with each other.

The scan step further comprises a step in which an initialization signal of the gate-on voltage is applied to the gate electrode of the initialization transistor transmitting the first power source voltage to the second node.

The scan step further comprises: a step in which a scan signal of the gate-on voltage is applied to the gate electrode of the reference voltage transistor; and the data voltage corresponding to the scan signal of the gate-on voltage is applied to the data line to be stored in the first capacitor.

The scan step further comprises: a step in which a compensation control signal of a gate-off voltage is applied to the gate electrode of the compensation transistor connecting the gate electrode of the driving transistor and the anode of the OLED; and a step in which the compensation control signal of a gate-off voltage is applied to the gate electrode of the switching transistor.

The scan step further comprises: a step in which the scan signal of the gate-on voltage is applied to the gate electrode of the second switching transistor connecting the data line and the first capacitor; and a step in which the data voltage corresponding to the scan signal of the gate-on voltage is applied to the data line to be stored in the first capacitor.

The scan step further comprises: a step in which a compensation control signal of the gate-off voltage is applied to the gate electrode of the compensation transistor connecting the gate electrode of the driving transistor and the anode of the organic light emitting diode (OLED); and a step in which the compensation control signal of the gate-off voltage is applied to the gate electrode of the switching transistor.

An initialization step in which an anode voltage of the OLED is reset may be further included.

The initialization step comprises: a step in which an initialization transistor transmitting the first power source voltage to the second node is turned on and the first power source voltage is changed into the low level voltage; a step in which the voltage of the third node is decreased by the coupling of the second capacitor; and a step in which a current flows from the anode of the OLED to the first power source voltage through the driving transistor such that the anode voltage of the OLED is decreased.

The initialization step comprises a step in which the second power source voltage applied to the cathode of the OLED is changed into the low level voltage after the anode voltage of the OLED is decreased such that the anode voltage of the OLED is further decreased by the coupling of the parasitic capacitor of the OLED.

The initialization step includes a step in which the compensation transistor connecting the gate electrode of the driving transistor and the anode of the OLED is turned on after the anode voltage of the OLED is further decreased such that the anode voltage of the OLED is reset.

The initialization step includes a step in which the second power source voltage is changed into the high level voltage after the anode voltage of the OLED is reset.

A compensation step in which the first power source voltage is changed into the high level voltage and the compensation transistor is turned on to diode-connect the driving transistor in a state in which the initialization transistor is turned on after the second power source voltage is changed into the high level voltage may be further included.

The compensation step further comprises: a step in which the initialization transistor is turned off after the driving transistor is diode-connected; a step in which the sustain voltage is applied to the data line and the switching transistor is turned on; and a step in which the voltage of the second node is changed by the data voltage stored in the first capacitor and the voltage reflecting the data voltage is stored in the second capacitor.

The step of storing the voltage reflecting the data voltage to the second capacitor comprises a step in which the data voltage stored in the first capacitor is a data voltage that is applied in a previous frame of a current frame and a voltage reflecting the data voltage that is applied in the previous frame is stored in the second capacitor.

The compensation step further comprises: the switching transistor and the compensation transistor being turned off after the voltage reflecting the data voltage is stored in the second capacitor, and a step in which the initialization transistor is turned on such that the voltage of the third node is changed.

The light emitting step further comprises: the first power source voltage being maintained as the high level voltage after the voltage of the third node is changed and the second power source voltage being changed into the low level voltage, and a step in which a driving current flows to the OLED through the driving transistor for light-emitting the OLED to emit light.

A bias step in which the second power source voltage is changed into the high level voltage and the compensation transistor is turned on to reset the voltages of the gate electrode and the other electrode of the driving transistor into a predetermined voltage after the OLED emits light may be further included.

An organic light emitting diode (OLED) pixel, according to another exemplary embodiment of the disclosed technology comprises: a first capacitor including one electrode connected to a data line and the other electrode connected to a first node; a switching transistor including a gate electrode, one electrode connected to the first node, and the other electrode connected to a second node; a second capacitor including one electrode connected to the second node and the other electrode connected to a third node; a driving transistor including a gate electrode connected to the third node, one electrode connected to a first power source voltage, and the other electrode connected to an anode of an organic light emitting diode (OLED); and a reference voltage transistor including a gate electrode, one electrode connected to a reference voltage, and the other electrode connected to the first node.

An initialization transistor including a gate electrode configured to be applied with an initialization signal, one electrode connected to a first power source voltage, and the other electrode connected to the second node may be further included.

A compensation transistor including a gate electrode configured to be applied with a compensation control signal, one electrode connected to the third node, and the other electrode connected to an anode of the OLED.

The scan signal is applied to the gate electrode of the reference voltage transistor.

A relay signal is applied to the gate electrode of the switching transistor.

The compensation control signal may be applied to the gate electrode of the switching transistor.

The initialization signal is applied to the gate electrode of the reference voltage transistor.

A second switching transistor including the gate electrode configured to be applied with the scan signal, one electrode connected to the data line, and the other electrode connected to one electrode of the first capacitor may be further included.

A relay signal is applied to the gate electrode of the switching transistor.

The compensation control signal is applied to the gate electrode of the switching transistor.

An organic light emitting diode (OLED) pixel, according to another exemplary embodiment of the disclosed technology comprises: a first capacitor including one electrode connected to a data line and the other electrode connected to a first node; a switching transistor including a gate electrode configured to be applied with a scan signal, one electrode connected to the first node, and the other electrode connected to a second node; a second capacitor including one electrode connected to the second node and the other electrode connected to a third node; a driving transistor including a gate electrode connected to the third node, one electrode connected to a first power source voltage, and the other electrode connected to an anode of an organic light emitting diode (OLED); a compensation transistor including a gate electrode applied with a compensation control signal, one electrode connected to the third node, and the other electrode connected to the anode of the OLED; and a reference voltage transistor including the gate electrode configured to be applied with an initialization signal, one electrode connected to the reference voltage, and the other electrode connected to the second node.

An organic light emitting diode (OLED) pixel, according to another exemplary embodiment of the disclosed technology comprises: a switching transistor including a gate electrode applied with a scan signal, one electrode connected to a data line, and the other electrode connected to a first node; a first capacitor including one electrode connected to the first node and the other electrode connected to a second node; a second capacitor including one electrode connected to the second node and the other electrode connected to a third node; a driving transistor including a gate electrode connected to the third node, one electrode connected to a first power source voltage, and the other electrode connected to an anode of an organic light emitting diode (OLED); a compensation transistor including a gate electrode configured to be applied with a compensation control signal, one electrode connected to the third node, and the other electrode connected to the anode of the OLED; and a reference voltage transistor including a gate electrode configured to be applied with an initialization signal, one electrode connected to a reference voltage, and the other electrode connected to the second node.

Accordingly, a pixel having a structure that stably realizes enlargement of a display panel, high-resolution, and display of a stereoscopic image and that can improve display quality of a display device is provided.

DETAILED DESCRIPTION OF CERTAIN INVENTIVE EMBODIMENTS

Figure 1:
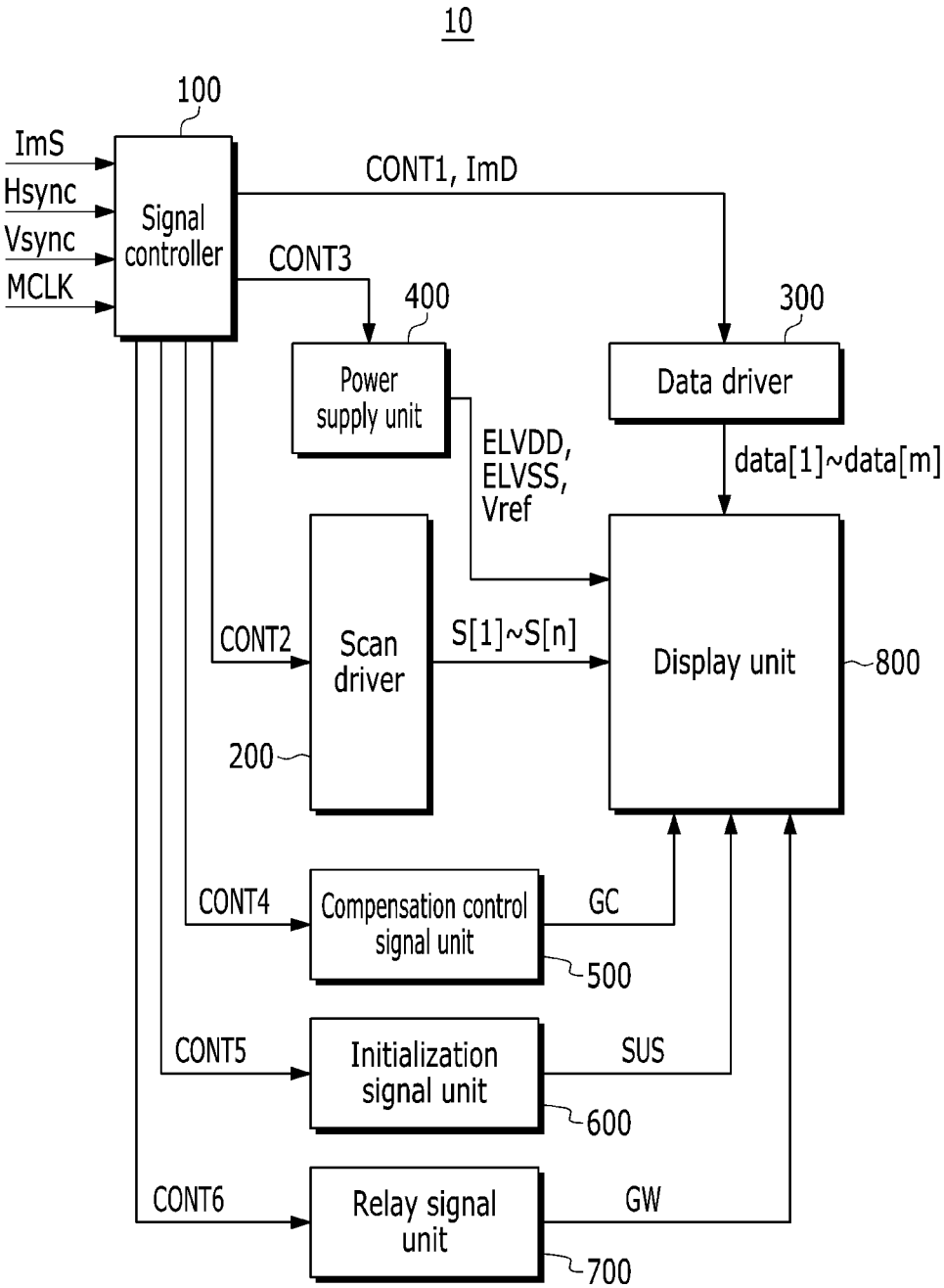
FIG. 1 is a block diagram of a display device according to an exemplary embodiment of the disclosed technology.

The disclosed technology will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in exemplary embodiments, like reference numerals designate like elements having the same configuration, a first exemplary embodiment is representatively described, and in other exemplary embodiments, only different configurations from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the disclosed technology.

Referring to FIG. 1, a display device 10 includes a signal controller 100, a scan driver 200, a data driver 300, a power supply unit 400, a compensation control signal unit 500, an initialization signal unit 600, a relay signal unit 700, and a display unit 800.

The signal controller 100 receives an image signal Ims and a synchronization signal input from an external device. The input image signal ImS includes luminance information of a plurality of pixels. Luminance has a predetermined number of grays, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates first to sixth driving control signals CONT1, CONT2, CONT3, CONT4, CONT5, and CNT6 and an image data signal ImD according to the image signal ImS, the horizontal synchronization signal Hsync, the vertical synchronization signal Vsync, and the main clock signal MCLK.

The signal controller 100 divides the image signal ImS per frame unit according to the vertical synchronization signal Vsync, and generates the image data signal ImD by dividing the image signal ImS by a scan line unit according to the horizontal synchronization signal Hsync. The signal controller 100 transmits the image data signal ImD along with the first driving control signal CONT1 to the data driver 300.

The display unit 700 is a display area including a plurality of pixels. In the display unit 700, a plurality of scan lines, a plurality of data lines, a plurality of power source lines, a plurality of initialization lines, a plurality of compensation control lines, and a plurality of relay lines are connected to a plurality of pixels. Here, the plurality of scan lines are substantially extended in a row direction and almost parallel with each other, and the plurality of data lines, the plurality of power source lines, the plurality of compensation control lines, the plurality of initialization lines, and the plurality of relay lines are substantially extended in a column direction and almost parallel with each other. The plurality of pixels are substantially arranged in a matrix format.

The scan driver 200 is connected to the plurality of scan lines, and generates a plurality of scan signals S[1] to S[n] according to the second driving control signal CONT2. The scan driver 200 may sequentially apply scan signals S[1] to S[n] of a gate-on voltage to the plurality of scan lines.

The data driver 300 is connected to the plurality of data lines, samples and holds the image data signal ImD input according to the first driving control signal CONT1, and transmits a plurality of data signals data[1]-data[m] to the plurality of data lines. The data driver 300 applies a data signal having a predetermined voltage range to the plurality of data lines corresponding to the scan signals S[1] to S[n] of the gate-on voltage.

The power supply unit 400 is connected to a plurality of power source lines, and provides the first power source voltage ELVDD), the second power source voltage ELVSS, and a reference voltage Vref to the plurality of power source lines. The power supply unit 400 may control the voltage level of the first power source voltage ELVDD, the second power source voltage ELVSS, and the reference voltage Vref according to the third driving control signal CONT3. The first power source voltage ELVDD and the second power source voltage ELVSS supply the driving voltage for the pixel operation.

The compensation control signal unit 500 is connected to a plurality of compensation control lines, and generates a compensation control signal GC according to the fourth driving control signal CONT4.

The initialization signal unit 600 is connected to a plurality of initialization lines, and generates an initialization signal SUS according to the fifth driving control signal CONT5.

The relay signal unit 700 is connected to a plurality of relay lines, and generates a relay signal GW according to the sixth driving control signal CONT6.

Figure 2:
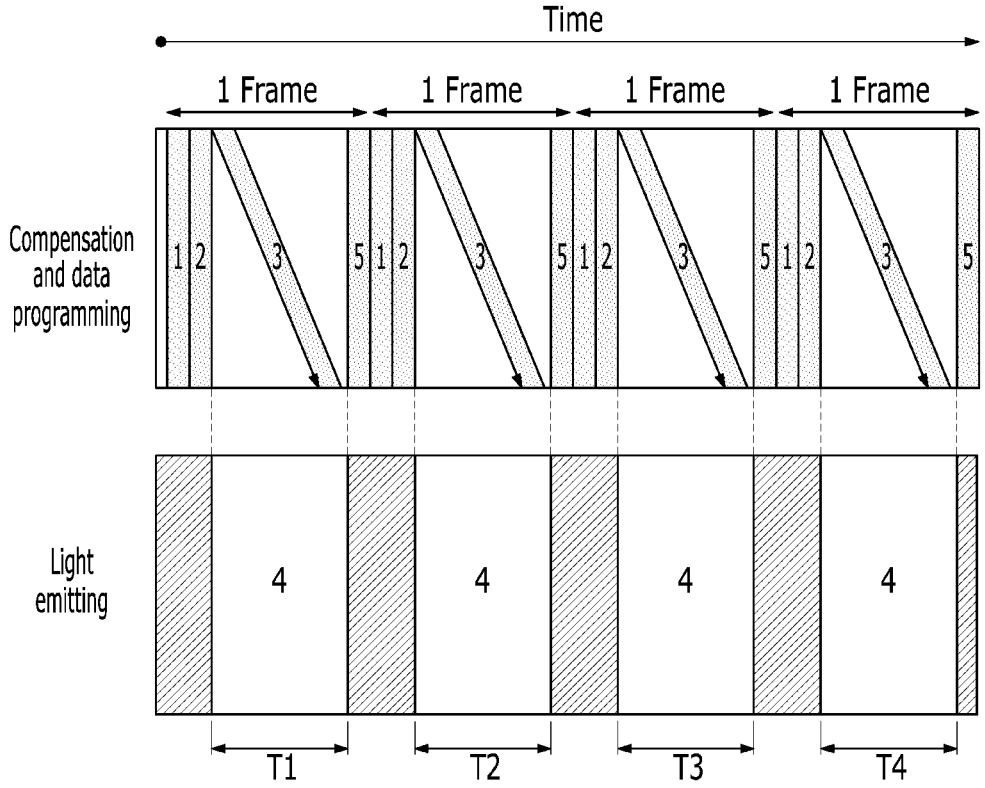
FIG. 2 shows a driving method of the display device according to the exemplary embodiment of the disclosed technology.

FIG. 2 is a view of a driving method of a display device according to an exemplary embodiment of the disclosed technology.

Referring to FIG. 2, one frame period during which a single image is displayed in the display unit 700 includes an initialization period 1 for initializing a driving voltage of an organic light emitting diode of each pixel, a compensation period 2 for compensating a threshold voltage of a driving transistor of each pixel, a scan period 3 for programming data to the respective pixels, a light emission period 4 for light emission of the plurality of pixels corresponding to the programmed data, and a bias period 5 for improving a response waveform of a plurality of pixels. The bias period 5 may be omitted according to the driving method of the display device.

The scan period 3 and the light emission period 4 are temporally overlapped. During the light emitting period 4 of the current frame, the pixel emits light according to the data written during the scan period 3 of the previous frame. Then, the pixel emits the light during the light emitting period 4 of the next frame according to the data written during the scan period 3 of the current frame.

For example, it is assumed that a period T1 includes a scan period 3 and a light emission period 4 of an N-th frame. Data programmed to the pixels during the scan period 3 of the period T1 is data of the N-th frame, and pixels emit light according to data of an (N−1)-th frame, programmed during a scan period 3 of the (N−1)-th frame during the light emission period 4 of the period T1.

A period T2 includes a scan period 3 and a light emission period 4 of the (N+1)-th frame. Data programmed to the pixels during the scan period 3 of the period T2 is data of the (N+1)-th frame, and the pixels emit light according to the data of the N-th frame, programmed during the scan period 3 of the N-th frame, that is, the period T1.

A period T3 includes a scan period 3 and a light emitting period 4 of the (N+2)-th frame. Data programmed to the pixels during the scan period 3 of the period T3 is data of the (N+2)-th frame, and the pixels emit light according to the data of the (N+1)-th frame, programmed during the scan period 3 of the (N+1)-th frame, that is, the period T2.

A period T4 includes a scan period 3 and a light emitting period 4 of the (N+3)-th frame. Data programmed to the pixels during the scan period 3 of the period T4 is data of the (N+3)-th frame, and the pixels emit light according to the data of the (N+2)-th frame, programmed during the scan period 3 of the (N+2)-th frame, that is, the period T3.

A pixel structure in which data of the present frame is programmed during the scan period 3 and light emission occurs according to data of the previous frame during a period overlapped with the scan period 3, that is, the light emission period 4, will be described with reference to FIG. 3.

Figure 3:
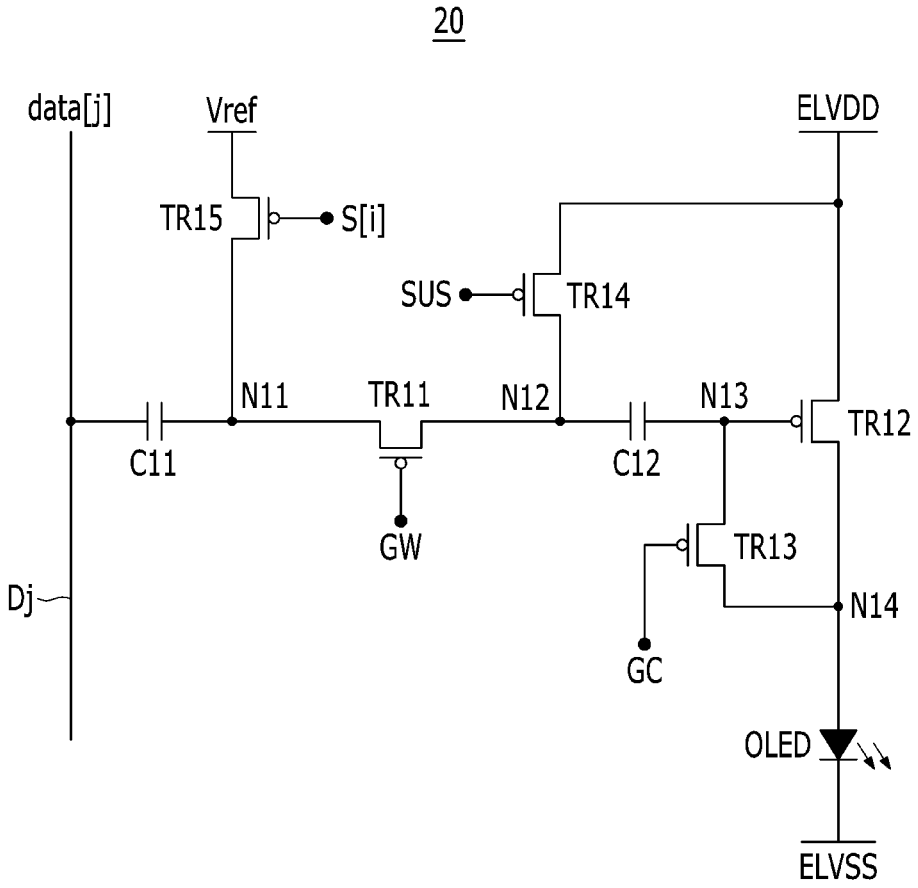
FIG. 3 is a circuit diagram of a pixel according to the exemplary embodiment of the disclosed technology.

FIG. 3 is a circuit diagram of a pixel according to an exemplary embodiment of the disclosed technology.

Referring to FIG. 3, a pixel 20 according to the first exemplary embodiment includes a switching transistor TR11, a driving transistor TR12, a compensation transistor TR13, an initialization transistor TR14, a reference voltage transistor TR15, a first capacitor C11, a second capacitor C12, and an organic light emitting diode (OLED).

The switching transistor TR11 includes the gate electrode applied with a relay signal GW, one electrode connected to the first node N11, and the other electrode connected to the second node N12. The switching transistor TR11 is turned on by the relay signal GW of a gate-on voltage to connect the first node N11 and the second node N12.

The driving transistor TR12 includes the gate electrode connected to the third node N13, one electrode connected to the first power source voltage ELVDD, and the other electrode connected to the fourth node N14. The driving transistor TR12 is turned on/off by the voltage of the third node N13 to control a driving current supplied to the OLED.

The compensation transistor TR13 includes a gate electrode connected to the compensation control line GC, one electrode connected to the third node N13, and the other electrode connected to the fourth node N14. The compensation transistor TR13 is turned on by the compensation control signal GC of the gate-on voltage to connect the gate electrode and the other electrode of the driving transistor TR12.

The initialization transistor TR14 includes the gate electrode applied with the initialization signal SUS, one electrode connected to the first power source voltage ELVDD, and the other electrode connected to the second node N12. The initialization transistor TR14 is turned on by the initialization signal GI of the gate-on voltage to transmit the first power source voltage ELVDD to the second node N12.

The reference voltage transistor TR15 includes the gate electrode connected to the scan line, one electrode connected to the reference voltage Vref, and the other electrode connected to the first node N11. The reference voltage transistor TR15 is turned on by the scan signal S[i] of the gate-on voltage to transmit the reference voltage Vref to the first node N11 ($1 \leq i \leq n$).

The first capacitor C11 includes one electrode connected to the data line Dj and the other electrode connected to the first node N11 ($1 \leq j \leq m$).

The second capacitor C12 includes one electrode connected to the second node N12 and the other electrode connected to the third node N13.

The OLED includes the anode of the fourth node N14 and the cathode connected to the second power source voltage ELVSS. The OLED emits light of one of primary colors. An example of the primary colors may include three primary colors such as red, green, and blue, and a desired color may be displayed by a spatial sum or a temporal sum of the three primary colors.

The switching transistor TR11, the driving transistor TR12, the compensation transistor TR13, the initialization transistor TR14, and the reference voltage transistor TR15 may be p-channel field effect transistors. At this time, a gate-on voltage turning on the switching transistor TR11, the driving transistor TR12, the compensation transistor TR13, the initialization transistor TR14, and the reference voltage transistor TR15 is a low level voltage, and a gate-off voltage turning them off is a high level voltage.

Here, at least one of the switching transistor TR11, the driving transistor TR12, the compensation transistor TR13, the initialization transistor TR14, and the reference voltage transistor TR15 may be n-channel field effect transistors. At this time, the gate-on voltage turning on the n-channel field effect transistor is the high level voltage and the gate off voltage turning it off is the low level voltage.

The switching transistor TR11, the driving transistor TR12, the compensation transistor TR13, the initialization transistor TR14, and the reference voltage transistor TR15 are typically thin film transistors and as such they may be formed of one of an amorphous silicon thin film transistor (a-Si TFT), a low temperature polysilicon (LTPS) thin film transistor, and an oxide thin film transistor (oxide TFT). The oxide TFT may have an activation layer of an oxide such as amorphous indium-gallium-zinc-oxide (IGZO), zinc-oxide (ZnO), titanium oxide (TiO), and the like.

Figure 4:
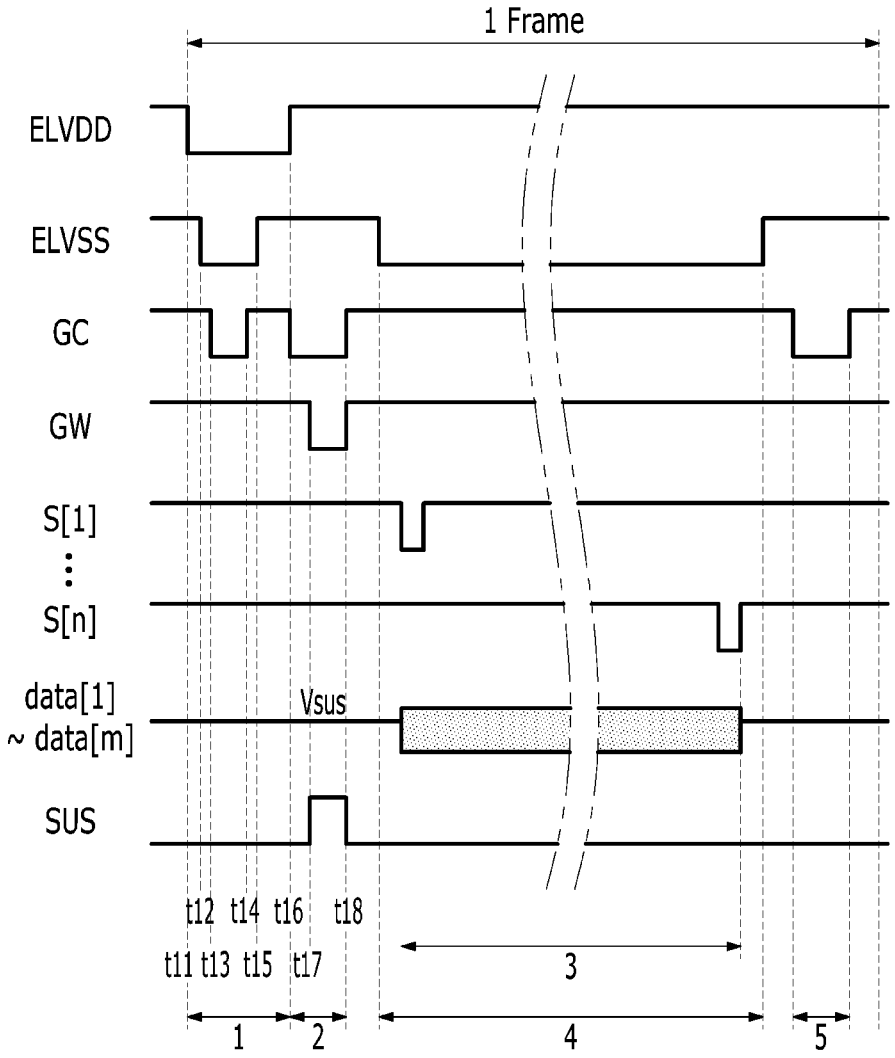
FIG. 4 is a timing diagram of the driving method of the display device according to the exemplary embodiment of the disclosed technology.

FIG. 4 is a timing diagram of a driving method of a display device according to an exemplary embodiment of the disclosed technology.

Referring to FIG. 1 to FIG. 4, a method for driving a display device including the pixel 20 according to an exemplary embodiment will be described.

During one frame, the first power source voltage ELVDD, the second power source voltage ELVSS, the scan signals S[1]-S[n], the compensation control signal GC, the relay signal GW, the initialization signal SUS, and the data signals data[1]-data[m] are changed according to the initialization period 1, the compensation period 2, the scan period 3, the light emitting period 4, and the bias period 5.

In the initialization period 1, the initialization signal SUS is applied as the low level voltage and the initialization transistor TR14 is turned on.

In a time t11 of the initialization period 1, the first power source voltage ELVDD is changed into the low level voltage and the first power source voltage ELVDD of the low level voltage is transmitted to the second node N12 through the turned-on initialization transistor TR14. The voltage of the second node N12 becomes the low level voltage and the voltage of the third node N13 is decreased according to the coupling by the second capacitor C12. The voltage of the third node N13 is a low voltage for turning on the driving transistor TR12 with a sufficiently low voltage. The current flows from the fourth node N14 to the first power source voltage ELVDD through the driving transistor TR12 such that the voltage of the fourth node N14 is decreased.

In a time t12 of the initialization period 1, if the second power source voltage ELVSS is changed into the low level voltage, the voltage of the fourth node N14 is further decreased according to the coupling by the parasitic capacitor the organic light emitting diode (OLED).

In a time 13 of the initialization period 1, the compensation control signal GC is applied as the low level voltage and the compensation transistor TR13 is turned on. As the compensation transistor TR13 is turned on, the third node N13 and the fourth node N14 are connected, and the voltage of the third node N13 and the fourth node N14 becomes the voltage of the level similar to the low level voltage of the first power source voltage ELVDD. That is, the voltage of the third node N13 and the anode voltage of the organic light emitting diode (OLED) are reset as the low level voltage.

In the time 14 of the initialization period 1, the compensation control signal GC is applied as the high level voltage and the compensation transistor TR13 is turned off.

In the time 15 of the initialization period 1, the second power source voltage ELVSS is changed into the high level voltage. If the second power source voltage ELVSS is changed into the high level voltage, the voltage of the fourth node N14 is increased by the parasitic capacitor of the organic light emitting diode (OLED). At this time, the compensation transistor TR13 is in the turn-off state, and the voltage of the third node N13 maintains the low level voltage such that the driving transistor TR12 is turned on by the gate-source voltage difference. The current flows from the fourth node N14 to the first power source voltage ELVDD through the turned-on driving transistor TR12 and the voltage of the fourth node N14 is again decreased.

In a time t16 of the compensation period 2, the first power source voltage ELVDD is changed into the high level voltage, and the compensation control signal GC is applied as the low level voltage. The compensation transistor TR13 is turned on by the compensation control signal GC such that the driving transistor TR12 is diode-connected. The voltage of the third node N13 becomes ELVDD+Vth. Here, ELVDD means the high level voltage of the first power source voltage ELVDD, and Vth means the threshold voltage of the driving transistor TR12. Here, the initialization signal SUS is applied as the low level voltage and the initialization transistor TR14 enters the turned-on state. The high level voltage of the first power source voltage ELVDD is transmitted to the second node N12 through the turned on initialization transistor TR14, and the voltage of the second node N12 becomes ELVDD.

In a time 17 of the compensation period 2, the relay signal GW is applied as the low level voltage and the initialization signal SUS is applied as the high level voltage. As the initialization signal SUS is applied as the high level voltage, the initialization transistor TR14 is turned off. As the relay signal GW is applied as the low level voltage, the switching transistor TR11 is turned on and the first node N11 and the second node N12 are connected. At this time, the data signal data[j] is applied as the sustain voltage Vsus. The voltage stored in the first capacitor C11 is a voltage stored in the first capacitor 11 during the scan period 3 of the previous frame of the current frame, and is Vref-data. The description thereof is described later in the description for the scan period 3. Data implies a voltage of the data signals data[1] to data[m]. In the state that the sustain voltage Vsus is applied to the data line Dj, as the switching transistor TR11 is turned on, the voltage of the second node N12 is changed by the voltage stored to the first capacitor C11. The voltage Vd of the second node N12 is changed as shown in Equation 1.

$$Vd=ELVDD+(Vref-data+Vsus-ELVDD)\times a$$

$$a=Cst/(Cst+Cx),$$

$$Cx=Cth\times(Cpara+Coled)/(Cth+Cpara+Coled) \quad \text{(Equation 1)}$$

Here, Vd means the voltage of the second node N12, Cst is the capacitance of the first capacitor C11, Cth means the capacitance of the second capacitor C12, Cpara is the parasitic capacitance of the driving transistor TR12, and Coled means the parasitic capacitance of the OLED. As the switching transistor TR11 is turned on, the second node N12 is applied with the voltage Vref-data+Vsus, however the parasitic capacitor Coled of the OLED, the parasitic capacitor Cpara of the driving transistor TR12, and the second capacitor C12 are coupled in series, and the first capacitor C11 is connected thereto such that the voltage Vd of the second node N12 is applied as shown in Equation 1. At this time, the voltage of the third node N13 is continuously applied as ELVDD+Vth, and the voltage of (ELVDD+Vth)−Vd is stored to the second capacitor C12. That is, the voltage Vd of the second node reflects the data voltage of the previous frame such that the voltage reflecting the data voltage of the previous frame is stored to the second capacitor C12.

In a time t18 of the compensation period 2, the compensation control signal GC and the relay signal GW are applied as the high level voltage and the initialization signal SUS is applied as the low level voltage. The switching transistor TR11 and the compensation transistor TR13 are turned off. The initialization transistor TR14 is turned on by the initialization signal SUS, and the first power source voltage ELVDD of the high level voltage is transmitted to the second node N12. As the voltage of the second node N12 is changed into ELVDD, the voltage Vg of the third node N13 is changed by the coupling according to the second capacitor C12 as shown in Equation 2.

$$\begin{aligned} Vg &= (ELVDD+Vth)+(ELVDD-Vd)\times\beta \\ &= (1+\beta)\times ELVDD+Vth-Vd\times\beta \\ &= (1+\beta)\times ELVDD+Vth- \\ &\quad \{ELVDD+(Vref-\text{data}+Vsus-ELVDD)\times\alpha\}\times\beta \\ &= ELVDD+Vth-(Vref-data+Vsus-ELVDD)\times \\ &\quad \alpha\times\beta \end{aligned} \quad \text{(Equation 2)}$$

$$\beta = Cth/(Cth+Cpara)$$

Here, Vg means the voltage of the third node N13, Cth means the capacitance of the second capacitor C12, and Cpara means the parasitic capacitance of the driving transistor TR12.

In the light emitting period 4, the first power source voltage ELVDD maintains the high level voltage and the second power source voltage ELVSS is changed into the low level voltage. As the second power source voltage ELVSS is changed into the low level voltage, the current flows to the OLED through the driving transistor TR12. The driving current I_OLED flowing to the organic light emitting diode OLED is as shown in Equation 3.

$$\begin{aligned} \text{I_OLED} &= k(Vgs-Vth)^2 \\ &= k\{ELVDD+Vth- \\ &\quad (Vref-\text{data}+Vsus-ELVDD)\times \\ &\quad \alpha\times\beta-ELVDD-Vth\}^2 \\ &= k\{(-Vref+data-Vsus+ELVDD)\times\alpha\times\beta\}^2 \end{aligned} \quad \text{(Equation 3)}$$

Here, k is a parameter determined according to a characteristic of the driving transistor TR12. The organic light emitting diode OLED emits light with brightness that corresponds to the driving current I_OLED. That is, the organic light emitting diode OLED emits light with brightness corresponding to the data voltage data regardless of the threshold voltage Vth of the driving transistor TR12. If the light emitting period 4 is finished, the second power source voltage ELVSS is changed into the high level voltage.

In the scan period 3, the plurality of scan signals S[1] to S[n] are sequentially applied as logic low level voltages to turn on the reference voltage transistor TR15, and the plurality of data signals data[1] to data[m] are applied corresponding to the plurality of scan signals S[1] to S[n]. At this time, the relay signal GW is applied as the high level voltage and the switching transistor TR11 enters the turn-off state. If the reference voltage transistor TR15 is turned on, the reference voltage Vref is transmitted to the first node N11. If the data voltage data is transmitted to the data line Dj during the reference voltage Vref is transmitted to the first node N11, the voltage Vref-data is stored to the first capacitor C11. After the voltage Vref-data is stored to the first capacitor C11, if the reference voltage transistor TR15 is turned off, the first node N11 enters the floating state, and although the voltage of the data line Dj is changed later, the voltage Vref-data stored to the first capacitor C11 is maintained. The Vref-data voltage stored in the first capacitor C11 is used during a light emission period 4 of the next frame.

In the bias period 5, the first power source voltage ELVDD and the second power source voltage ELVSS are applied as the high level voltage and the compensation control signal GC is applied as the low level voltage. The compensation transistor TR13 is turned on by the compensation control signal GC, and the third node N13 and the fourth node N14 are connected such that the voltage of the third node N13 and the fourth node N14 is reset into a predetermined voltage. That is, the voltage of the gate, source, and drain of the driving transistor TR12 is applied with a predetermined value and a response waveform of the pixel may be improved. The bias period 5 may be omitted.

As described above, the proposed pixel 20 simultaneously performs the data writing and the light emitting such that sufficient data writing time may be obtained, thereby realizing a large-sized and high resolution display panel, and two capacitors are used such that a sufficient aperture ratio may be obtained.

Also, the proposed pixel 20 is driven with reference to the data line and the reference voltage Vref under the data writing, and although the first power source voltage ELVDD is changed according to the light emitting driving, the correct data signal may be programmed to the first capacitor C11 regardless.

Figure 5:
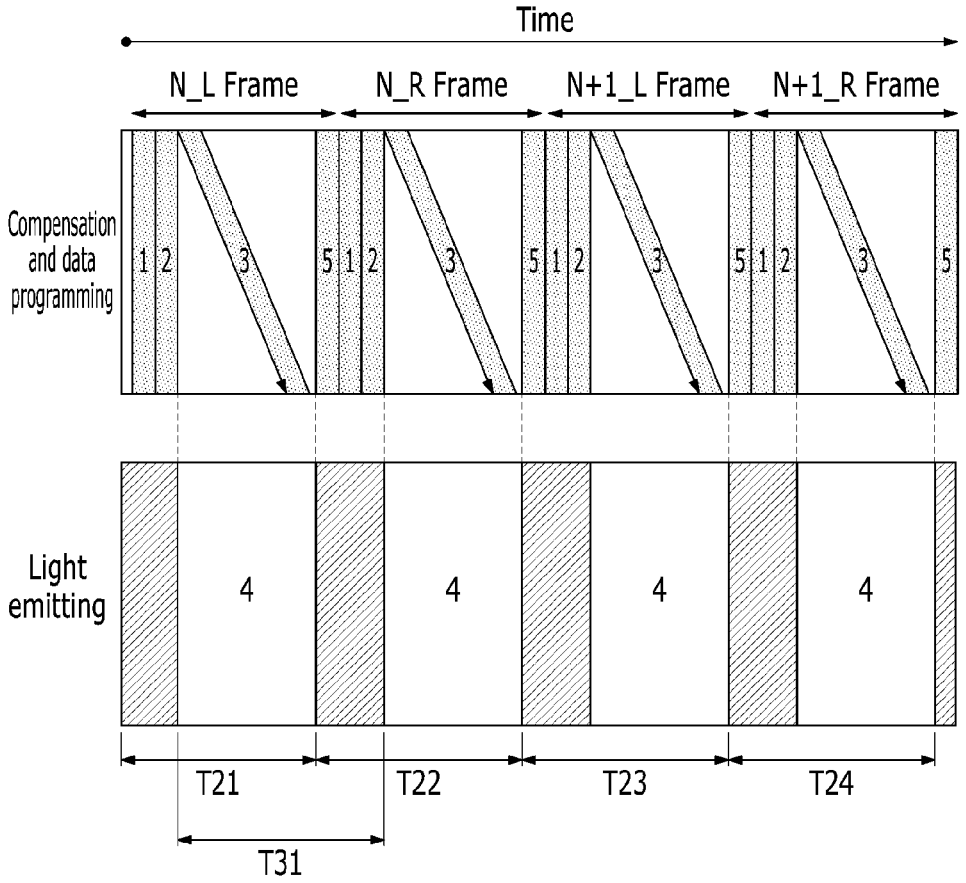
FIG. 5 shows a driving method of a display device according to another exemplary embodiment of the disclosed technology.

FIG. 5 shows a driving method of a display device according to another exemplary embodiment of the disclosed technology.

Referring to FIG. 5, a display device 10 alternately displays a left-eye image and a right-eye image according to a shutter glasses method. As shown in FIG. 5, each frame includes an initialization period 1, a compensation period 2, a scan period 3, a light emitting period 4, and a bias period 5.

A frame of which a plurality of data signals (hereinafter referred to as left-eye image data signals) representing a left-eye image are programmed to a plurality of pixels is denoted using referential numeral "L", and a frame of which a plurality of data signals (hereinafter referred to as right-eye image data signals) representing a right-eye image are programmed to the respective pixels is denoted using referential numeral "R".

In each of the initialization period 1, the compensation period 2, the scan period 3, the light emitting period 4, and the bias period 5, the first power source voltage ELVDD, the second power source voltage ELVSS, the compensation control signal GC, the relay signal GW, the scan signals S[1]-S[n], the data signals data[1]-data[m], and the initialization signal SUS have the same waveforms of those shown in FIG. 4, and therefore no further description will be provided.

During a scan period 3 of a period T21, left-eye image data signals of an N_L frame are programmed to the plurality of pixels. During the scan period 3, a left-eye image data signal corresponding to each of the plurality of pixels is programmed. In this case, the plurality of pixels emit light according to a right-eye image data signal programmed during the scan period 3 of an N−1_R frame during a light emission period 4 of the period T21.

During a scan period 3 of a period T22, right-eye image data signals of the N_R frame are programmed to the plurality of pixels. That is, during the scan period, a right-eye image data signal corresponding to each of the plurality of pixels is programmed. In this case, the plurality of pixels emit light according to the left-eye image data signals programmed during the scan period 3 of the N_L frame during a light emission period 4 of the period T22.

During a scan period 3 of a period T23, left-eye image data signals of an N+1_L frame are programmed to the plurality of pixels. During the scan period 3, a left-eye image data signal corresponding to each of the plurality of pixels is programmed. In this case, the plurality of pixels emit light according to the right-eye image data signals programmed during the scan period 3 of the N_R frame during the light emission period 4 of the period T23.

During a scan period 3 of a period T24, right-eye image data signals of the N+1_R frame are programmed to the plurality of pixels. During the scan period 3, a right-eye image data signal corresponding to each of the plurality of pixels is programmed. In this case, the plurality of pixels emit light according to the left-eye image data signals programmed on the scan period 3 of the N+1_L frame during the light emitting period 4 of the period T24.

With such a method, the right-eye image is simultaneously light-emitted while the left-eye image is programmed, and the left-eye image is simultaneously light-emitted while the right-eye image is programmed. Then, a sufficient light emission period can be assured, thereby improving image quality of a stereoscopic image.

Since the scan period 3 and the light emission period 4 are included in the same period, a gap T31 between light emission periods 4 of the respective frames can be set without regard to the scan period. In this case, a gap optimized in liquid crystal response speed of shutter glasses may be set as the gap T31 between the light emission period 4.

In a conventional case, a scan period 3 and a light emission period 4 are not included in the same period. In this case, the light emission period 4 is provided after the scan period 3, and therefore a temporal margin for setting the light emission period 4 during one frame period is decreased. According to the suggested driving method, the light emission period 4 may be set during a period excluding an initialization period and a compensation period during one frame period. Thus, the temporal margin for setting the light emission period 4 can be increased compared to the conventional case such that the gap T31 between the light emission periods 4 can be set in consideration of the liquid crystal response speed of the shutter glasses.

For example, the gap T31 between the light emission periods 4 may be set in consideration of a time consumed for completely opening a right-eye lens (or a left-eye lens) of the shutter glasses from the end of light emission of the left-eye image (or right-eye image).

Figure 6:
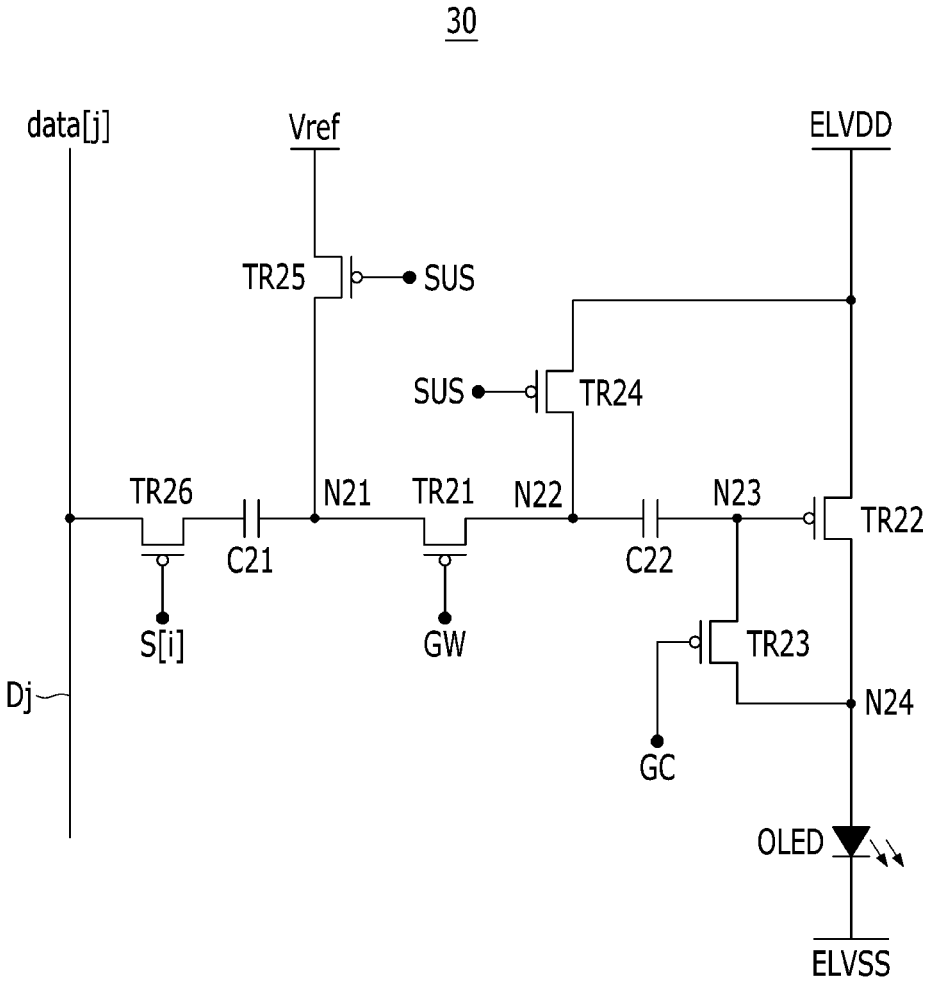
FIG. 6 is a circuit diagram of a pixel according to the other exemplary embodiment of the disclosed technology.

FIG. 6 is a circuit diagram of a pixel according to another exemplary embodiment of the disclosed technology.

Referring to FIG. 6, the pixel 30 includes a first switching transistor TR21, a driving transistor TR22, a compensation transistor TR23, an initialization transistor TR24, a reference voltage transistor TR25, a second switching transistor TR26, a first capacitor C21, a second capacitor C22, and an organic light emitting diode (OLED).

Unlike the pixel 20 of the first exemplary embodiment, the initialization signal SUS is applied to the gate electrode of the reference voltage transistor TR25, and the second switching transistor TR26 is further included between the first capacitor C21 and the data line Dj.

The reference voltage transistor TR25 is turned by the initialization signal SUS of the gate-on voltage to transmit the reference voltage Vref to a first node N21.

The second switching transistor TR26 includes the gate electrode connected to the scan line, one electrode connected to the data line Dj, and the other electrode connected to one electrode of the first capacitor C21. The second switching transistor TR26 is turned on by the scan signal S[i] of the gate-on voltage to transmit the voltage applied to the data line Dj to one electrode of the first capacitor C21.

The first capacitor C21 includes one electrode connected to the other electrode of the second switching transistor TR26 and the other electrode connected to the first node N21.

The constituent elements of the pixel 30 of FIG. 6 are the same as that of the pixel 20 of FIG. 3 and are not described in further detail.

Figure 7:
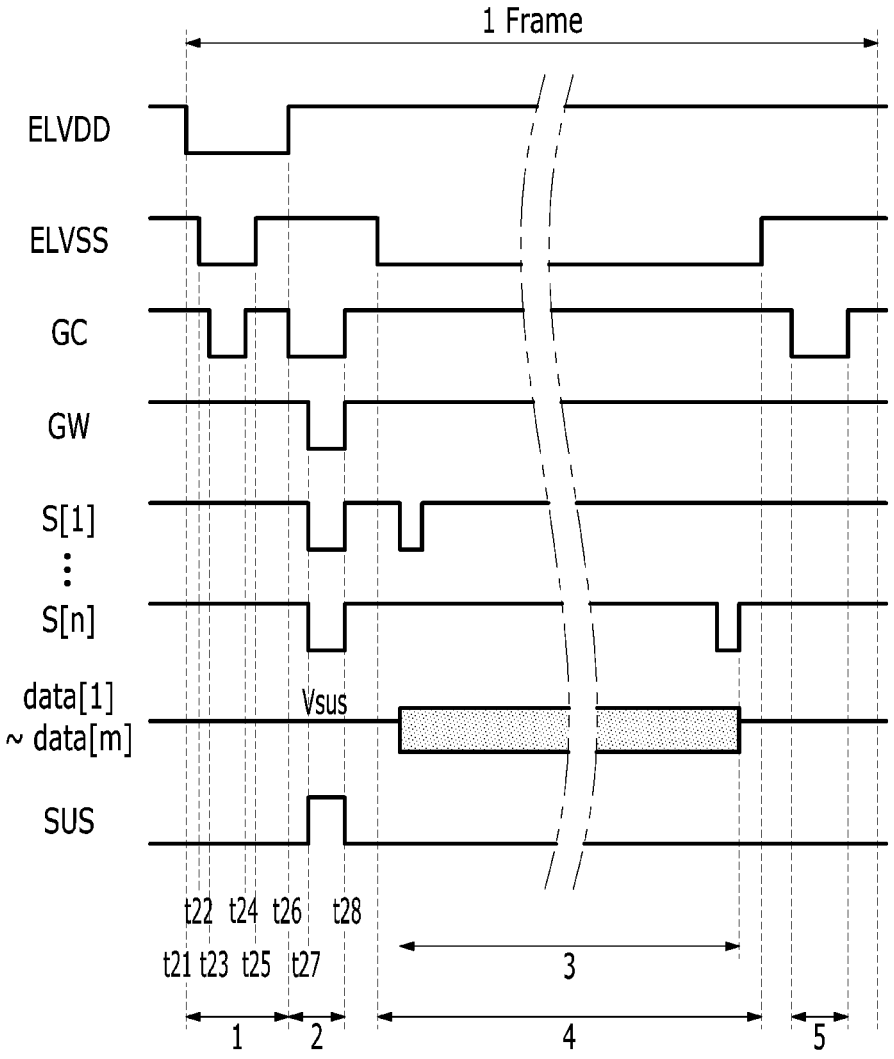
FIG. 7 is a timing diagram of a driving method of a display device according to another exemplary embodiment of the disclosed technology.

FIG. 7 is a timing diagram of a driving method of a display device according to another exemplary embodiment of the disclosed technology.

Referring to FIGS. 6 and 7, the driving method of the display device including the pixel 30 of FIG. 6 will be described. Differences from the driving method of the display device including the pixel 20 of FIG. 3 described in FIG. 4 will be mainly described.

In the initialization period 1, the initialization signal SUS is applied as the low level voltage. The initialization transistor TR24 and the reference voltage transistor TR25 are turned on, the first node N21 is applied with the reference voltage Vref, and the second node N22 is applied with the first power source voltage ELVDD. At this time, the relay signal GW and a plurality of scan signals S[1]-S[n] are applied as the high level voltage, and the first switching transistor TR21 and the second switching transistor TR26 maintain the turned off state. Accordingly, the first capacitor C21 is maintained with the voltage Vref-data stored in the previous frame. The operation between the time t21 to the time t26 that are not described is the same as that of the time t11 to the time t16 that are described in FIG. 4 and is not described in further detail.

The operation of the time t26 of the compensation period 2 is the same as the time t16 of FIG. 4 and is not described in further detail.

In the time t27 of the compensation period 2, the relay signal GW and a plurality of scan signals S[1]-S[n] are applied as the low level voltage, and the initialization signal SUS is applied as the high level voltage. As the initialization signal SUS is applied as the high level voltage, the initialization transistor TR24 and the reference voltage transistor TR25 are turned off. As the relay signal GW and a plurality of scan signals S[1]-S[n] are applied as the low level voltage, the first switching transistor TR21 and the second switching transistor TR26 are turned on. At this time, the data signal data[j] is applied as the sustain voltage Vsus. One electrode of the first capacitor C21 is connected to the data line Dj, and one electrode of the first capacitor C21 is applied with the sustain voltage Vsus. In the state that one electrode of the first capacitor C21 is applied with the sustain voltage Vsus, as the switching transistor TR21 is turned on, the voltage Vd of the second node N22 is changed as in Equation 1 described in FIG. 4 by the voltage stored to the first capacitor C21. At this time, the voltage of the third node N23 is continuously applied as ELVDD+Vth, and the second capacitor C22 is stored with the voltage of (ELVDD+Vth)−Vd. That is, the second capacitor C22 is stored with the voltage reflecting the data voltage of the previous frame.

In the time t28 of the compensation period 2, the compensation control signal GC, the relay signal GW, and the plurality of scan signals S[1]-S[n] are applied as the high level voltage, and the initialization signal SUS is applied as the low level voltage. The first switching transistor TR21, the compensation transistor TR13, and the second switching transistor TR26 are turned off. The initialization transistor TR24 and the reference voltage transistor TR25 are turned on by the initialization signal SUS. The first power source voltage ELVDD of the high level voltage is transmitted to the second node N12, and the reference voltage Vref is transmitted to the first node N21. As the voltage of the second node N22 is changed into ELVDD, the voltage Vg of the third node N23 is changed by the coupling of the second capacitor C22 as shown in Equation 2 described in FIG. 4.

In the light emitting period 4, the first power source voltage ELVDD maintain the high level voltage, and the second power source voltage ELVSS is changed into the low level voltage. As the second power source voltage ELVSS is changed into the low level voltage, the current flows to the OLED through the driving transistor TR22. The driving current I_OLED flowing in the OLED is the same as that of Equation 3 described in FIG. 4.

In the scan period 3, the plurality of scan signals S[1] to S[n] are sequentially applied as logic low level voltages to turn on the second switching transistor TR26, and the plurality of data signals data[1] to data[m] are applied corresponding to the plurality of scan signals S[1] to S[n]. In this time, the initialization signal SUS is applied as the low level voltage, and the reference voltage transistor TR25 is in the turned on state. Also, the relay signal GW is applied as the high level voltage, and the first switching transistor TR21 is in the turned off state. As the reference voltage Vref is transmitted to the first node N21 and the second switching transistor TR26 is turned on, the data voltage data of the data line Dj is transmitted to the first capacitor C21. The voltage Vref-data is stored to the first capacitor C21. The voltage Vref-data stored to the first capacitor C21 is used in the light emitting period 4 of the next frame.

Here, the operation of the bias period 5 is the same as that of the bias period 5 in FIG. 4 and is not described in further detail.

Figure 8:
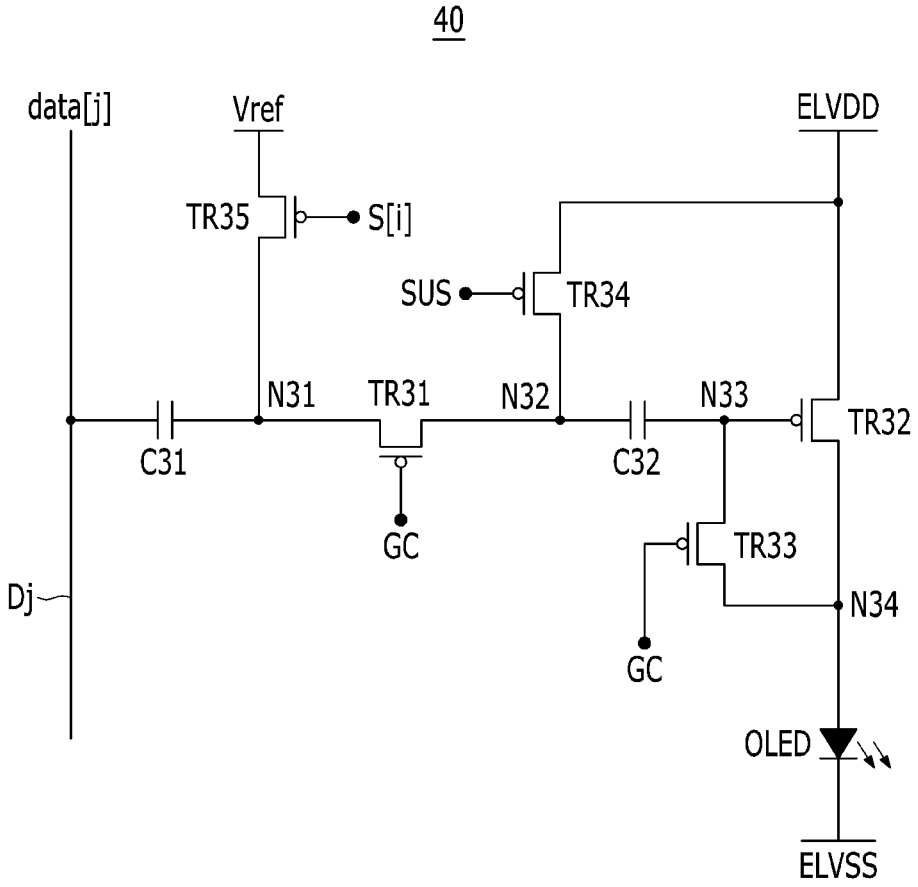
FIG. 8 is a circuit diagram of a pixel according to another exemplary embodiment of the disclosed technology.

FIG. 8 is a circuit diagram of a pixel according to another exemplary embodiment of the disclosed technology.

Referring to FIG. 8, the pixel 40 includes a switching transistor TR31, a driving transistor TR32, a compensation transistor TR33, an initialization transistor TR34, a reference voltage transistor TR35, a first capacitor C31, a second capacitor C32, and an OLED.

As a difference from the pixel 20 of FIG. 3, the compensation control signal GC is applied to the gate electrode of the switching transistor TR31. The switching transistor TR31 is turned on by the compensation control signal GC of the gate-on voltage to connect the first node N31 and the second node N32.

The other constituent elements of the pixel 40 are the same as that of the pixel 20 of FIG. 3 and are not described in further detail.

Figure 9:
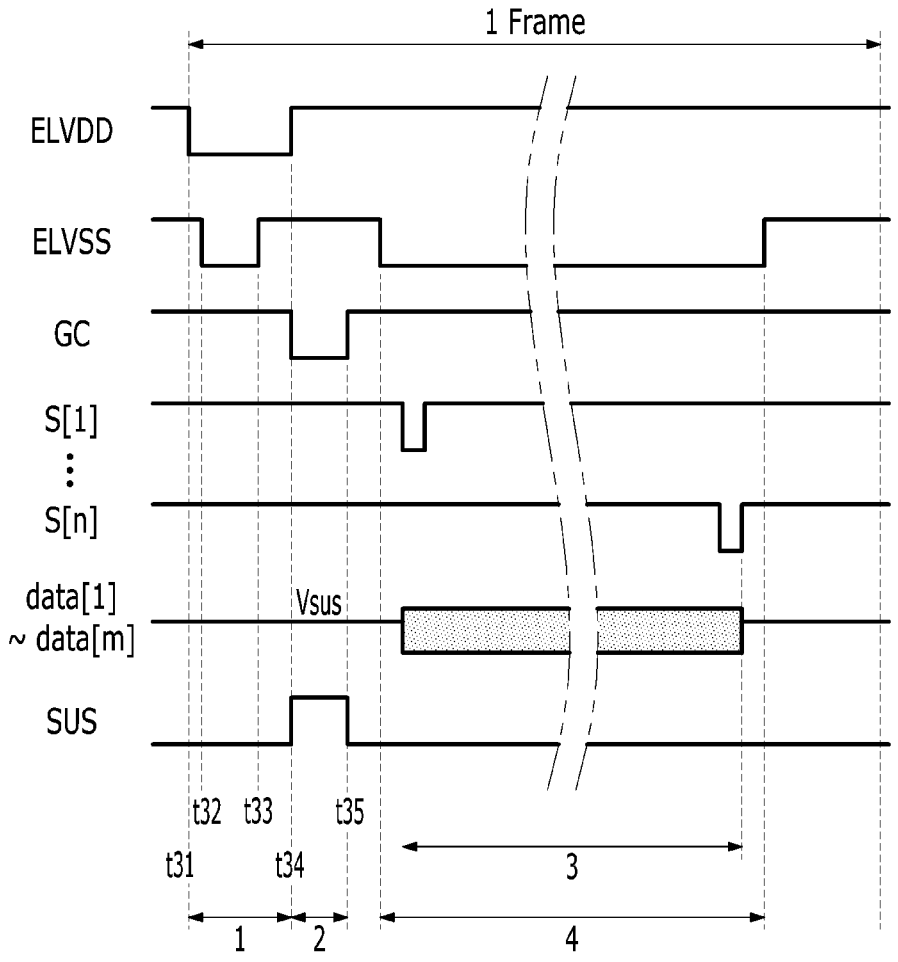
FIG. 9 is a timing diagram of a driving method of a display device according to another exemplary embodiment of the disclosed technology.

FIG. 9 is a timing diagram of a driving method of a display device according to another exemplary embodiment of the disclosed technology.

Referring to FIG. 8 and FIG. 9, a method for driving a display device including the pixel 40 of FIG. 8 according to the first exemplary embodiment will be described. Differences from the driving method of the display device including the pixel 20 of FIG. 3 described in FIG. 4 will be described.

In the initialization period 1, the initialization signal SUS is applied as the low level voltage and the initialization transistor TR34 is turned on.

In the time t31 of the initialization period 1, the first power source voltage ELVDD is changed into the low level voltage, and the first power source voltage ELVDD of the low level voltage is transmitted to the second node N32 through the turned-on initialization transistor TR34. The voltage of the second node N32 becomes the low level voltage, and the voltage of the third node N33 is decreased by the coupling of the second capacitor C32. The voltage of the third node N33 is a sufficiently low voltage for turning on the driving transistor TR32. The current flows from the fourth node N34 to the first power source voltage ELVDD through the driving transistor TR32 such that the voltage of the fourth node N34 is decreased.

In the time t32 of the initialization period 1, if the second power source voltage ELVSS is changed into the low level voltage, the voltage of the fourth node N34 is further decreased by the coupling of the parasitic capacitor of the OLED. That is, the anode voltage of the OLED (OLED) is reset as the low level voltage.

In the time t33 of the initialization period 1, the second power source voltage ELVSS is changed into the high level voltage. If the second power source voltage ELVSS is changed into the high level voltage, the voltage of the fourth node N34 is increased by the coupling of the parasitic capacitor of the OLED. At this time, the compensation transistor TR33 is in the turn-off state and the voltage of the third node N33 maintains the low level voltage such that the driving transistor TR32 is turned on by the voltage difference between the gate-source. The current flows from the first power source voltage ELVDD to the fourth node N14 through the turned on driving transistor TR32 and the voltage of the fourth node N34 is again decreased.

In the time t34 of the compensation period 2, the first power source voltage ELVDD is changed into the high level voltage. Also, the compensation control signal GC is increased as the low level voltage and the initialization signal SUS is increased as the high level voltage. The compensation transistor TR33 is turned on by the compensation control signal GC to diode-connect the driving transistor TR32. The voltage of the third node N33 becomes ELVDD+Vth. The initialization transistor TR34 is turned off by the initialization signal SUS. As the initialization signal SUS is applied as the low level voltage during the initialization period 1, the voltage of the second node N32 is ELVDD. In the time t34, as the compensation control signal GC is applied as the low level voltage, the switching transistor TR31 is turned on and the first node N31 and the second node N32 are connected. At this time the, data signal data[j] is applied as the sustain voltage Vsus. The voltage stored in the first capacitor C31 is a voltage stored in the first capacitor 31 during the scan period 3 of the frame previous to the current frame, and is Vref-data. In the state that the sustain voltage Vsus is applied to the data line Dj, as the switching transistor TR31 is turned on, the voltage of the second node N12 is changed by the voltage stored to the first capacitor C31 as shown in Equation 1 described in FIG. 4. At this time, the voltage of the third node N33 is continuously applied as ELVDD+Vth, and the second capacitor C32 stores the voltage of (ELVDD+Vth)−Vd. That is, the second capacitor C32 stores the voltage reflecting the data voltage of the previous frame.

In the time t35 of the compensation period 2, the compensation control signal GC is applied as the high level voltage, and the initialization signal SUS is applied as the low level voltage. The switching transistor TR31 and the compensation transistor TR33 are turned off. The initialization transistor TR4 is turned on by the initialization signal SUS, and the first power source voltage ELVDD of the high level voltage is transmitted to the second node N32. As the voltage of the second node N32 is changed into ELVDD, the voltage Vg of the third node N33 is changed by the coupling according to the second capacitor C32 as shown in Equation 2 described in FIG. 4.

Here, the operation in the light emitting period 4 and the scan period 3 is the same as that of the light emitting period 4 and the scan period 3 in FIG. 4 and is not described in further detail.

Here, the bias period 5 is omitted.

Figure 10:
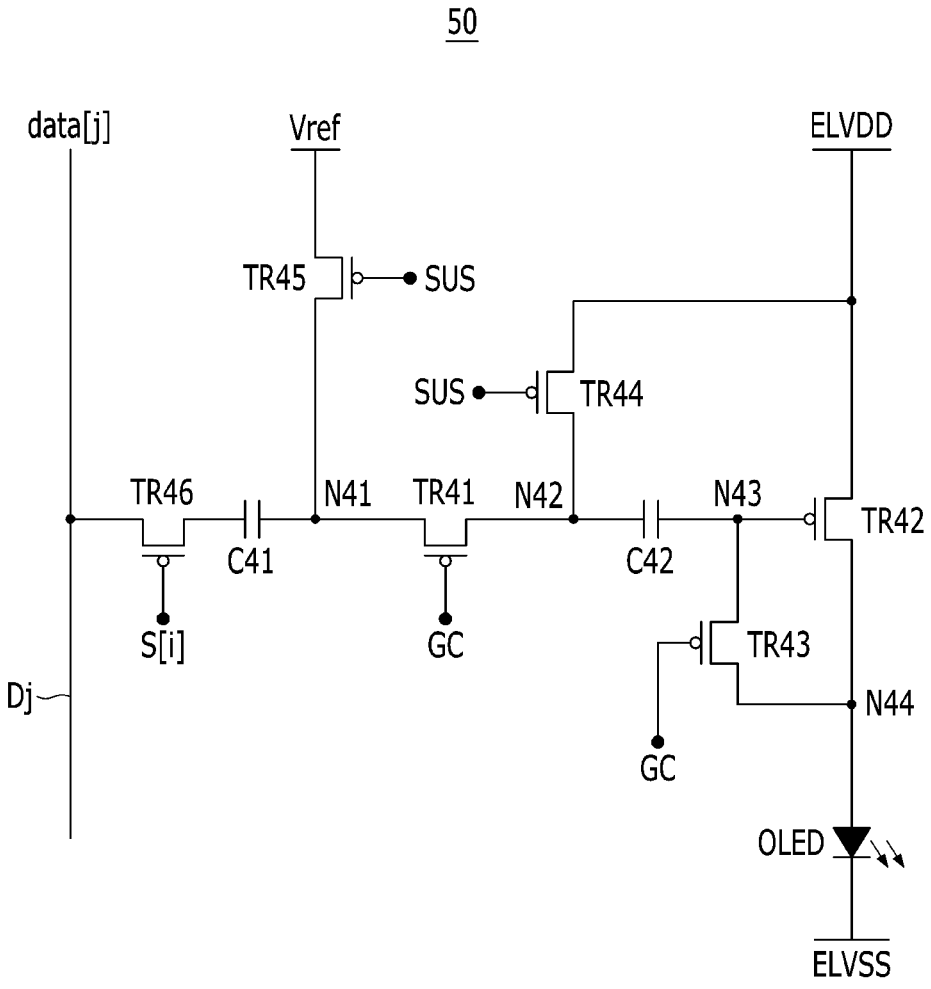
FIG. 10 is a circuit diagram of a pixel according to another exemplary embodiment of the disclosed technology.

FIG. 10 is a circuit diagram of a pixel according to another exemplary embodiment of the disclosed technology.

Referring to FIG. 10, the pixel 50 includes a first switching transistor TR41, a driving transistor TR42, a compensation transistor TR43, an initialization transistor TR44, a reference voltage transistor TR45, a second switching transistor TR46, a first capacitor C41, a second capacitor C42, and an organic light emitting diode (OLED).

As a difference from the pixel 30 of FIG. 6, the compensation control signal GC is applied to the gate electrode of the switching transistor TR41. The switching transistor TR41 is turned on by the compensation control signal GC of the gate-on voltage to connect the first node N41 and the second node N42.

The other constituent elements of the pixel 50 of FIG. 10 are the same as those of the pixel 30 of FIG. 6 and are not described in further detail.

Figure 11:
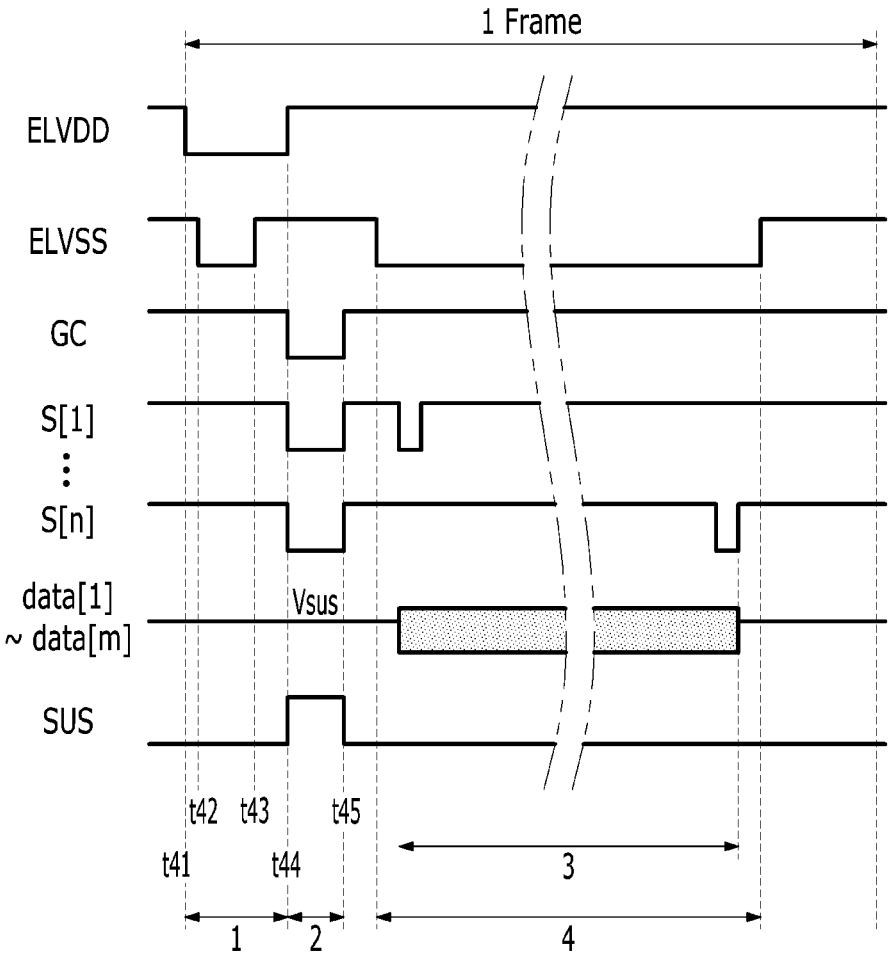
FIG. 11 is a timing diagram of a driving method of a display device according to another exemplary embodiment of the disclosed technology.

FIG. 11 is a timing diagram of a driving method of a display device according to another exemplary embodiment of the disclosed technology.

Referring to FIGS. 10 and 11, the driving method of the display device including the pixel 50 of FIG. 10 will be described.

Differences from the driving method of the display device including the pixel 20 of FIG. 6 described in FIG. 7 will be mainly described.

In the initialization period 1, the initialization signal SUS is applied as the low level voltage. The initialization transistor TR44 and the reference voltage transistor TR45 are turned on, the first node N41 is applied with the reference voltage Vref, and the second node N42 is applied with the first power source voltage ELVDD. At this time, the compensation signal GC and a plurality of scan signals S[1]-S[n] are applied as the high level voltage, and the first switching transistor TR41 and the second switching transistor TR46 maintain the turn-off state. Accordingly, the first capacitor C41 is maintained with the voltage Vref-data stored in the previous frame.

In the time t41 of the initialization period 1, the first power source voltage ELVDD is changed into the low level voltage, and the first power source voltage ELVDD of the low level voltage is transmitted to the second node N42 through the turned-on initialization transistor TR44. The voltage of the second node N42 becomes the low level voltage, and the voltage of the third node N43 is decreased by the coupling of the second capacitor C42. The voltage of the third node N43 becomes the sufficient low voltage for turning on the driving transistor TR42. The current flows from the fourth node N44 to the first power source voltage ELVDD through the driving transistor TR42 such that the voltage of the fourth node N44 is decreased.

In the time t42 of the initialization period 1, if the second power source voltage ELVSS is changed into the low level voltage, the voltage of the fourth node N44 is further decreased by the coupling of the parasitic capacitor of the OLED. That is, the anode voltage of the OLED is reset into the low level voltage.

In the time t43 of the initialization period 1, the second power source voltage ELVSS is changed into the high level voltage. If the second power source voltage ELVSS is changed into the high level voltage, the voltage of the fourth node N44 is increased by the parasitic capacitor of the OLED. At this time, the compensation transistor TR43 is in the turn-off state, and the voltage of the third node N43 maintains the low level voltage such that the driving transistor TR42 is turned on by the voltage difference between the gate-source. The current flows from the fourth node N44 to the first power source voltage ELVDD through the turned-on driving transistor TR42 and the voltage of the fourth node N44 is again decreased.

In the time t44 of the compensation period 2, the first power source voltage ELVDD is changed into the high level voltage. Also, the compensation control signal GC and a plurality of scan signals S[1]-S[n] are applied as the low level voltage and the initialization signal SUS is applied as the high level voltage. The compensation transistor TR33 is turned on by the compensation control signal GC to diode-connect the driving transistor TR32. The voltage of the third node N33 becomes ELVDD+Vth. The initialization transistor TR34 is turned off by the initialization signal SUS. During the initialization period 1, as the initialization signal SUS is applied as the low level voltage, the voltage of the second node N32 is ELVDD. In the time t44, as the compensation control signal GC and a plurality of scan signals S[1]-S[n] are applied as the low level voltage, the first switching transistor TR41 and the second switching transistor TR46 are turned on. At this time, the data signal data[j] is applied as the sustain voltage Vsus. The voltage stored in the first capacitor C41 is a voltage stored in the first capacitor 41 during the scan period 3 of the previous frame of the current frame, and is Vref-data. In the state that the sustain voltage Vsus is applied to the data line Dj, as the switching transistor TR41 and the second switching transistor TR46 are turned on, the voltage of the second node N42 is changed by the voltage stored to the first capacitor C41 as shown in Equation 1 described in FIG. 4. At this time, the voltage of the third node N43 is continuously applied as ELVDD+Vth, and the second capacitor C42 stores the voltage of (ELVDD+Vth)−Vd. That is, the second capacitor C42 stores the voltage reflecting the data voltage of the previous frame.

In the time t45 of the compensation period 2, the compensation control signal GC and a plurality of scan signals S[1]-S[n] are applied as the high level voltage, and the initialization signal SUS is applied as the low level voltage. The first switching transistor TR41, the compensation transistor TR43, and the second switching transistor TR46 are turned off. The initialization transistor TR4 is turned-on by the initialization signal SUS, and the first power source voltage ELVDD of the high level voltage is transmitted to the second node N42. The voltage of the second node Ne2 is changed into ELVDD such that the voltage Vg of the third node N43 is changed by the coupling according to the second capacitor C42 as shown in Equation 2 described in FIG. 4.

Here, the operation in the light emitting period 4 is the same as that of the light emitting period 4 in FIG. 4 and is not described in further detail.

In the scan period 3, the plurality of scan signals S[1] to S[n] are sequentially applied as logic low level voltages to turn on the second switching transistor TR46, and the plurality of data signals data[1] to data[m] are applied corresponding to the plurality of scan signals S[1] to S[n]. In this time, the initialization signal SUS is applied as the low level voltage, and the reference voltage transistor TR25 is in the turned-on state. Also, the compensation control signal GC is applied as the high level voltage, and the first switching transistor TR41 is in the turned-off state. As the reference voltage Vref is transmitted to the first node N41 and the second switching transistor TR46 is turned on, the data voltage data of the data line Dj is transmitted to the first capacitor C41. The voltage Vref-data is stored to the first capacitor C41. The voltage Vref-data stored to the first capacitor C41 is used in the light emitting period 4 of the next frame.

Here, the bias period 5 is omitted.

Figure 12:
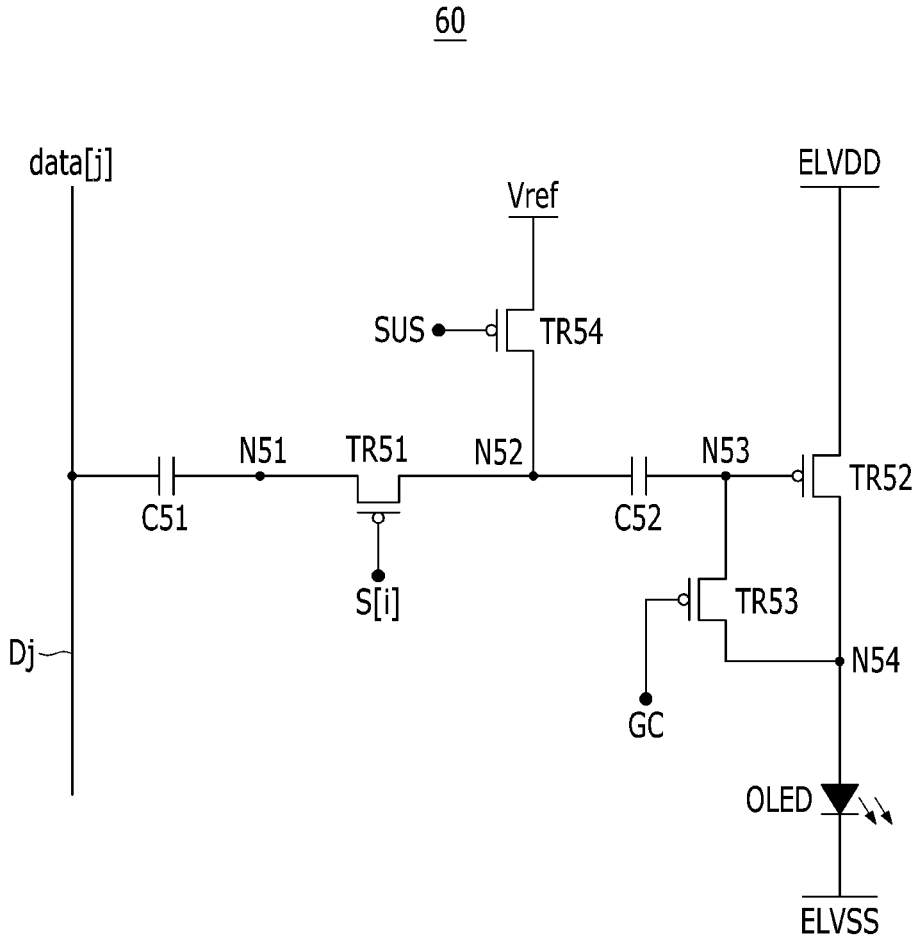
FIG. 12 is a circuit diagram of a pixel according to another exemplary embodiment of the disclosed technology.

FIG. 12 is a circuit diagram of a pixel according to another exemplary embodiment of the disclosed technology.

Referring to FIG. 12, a pixel 60 includes a switching transistor TR51, a driving transistor TR52, a compensation transistor TR53, an initialization transistor TR54, first capacitor C51, second capacitor C52, and an organic light emitting diode (OLED).

The switching transistor TR51 includes the gate electrode applied with the scan signal S[i], one electrode connected to the first node N51, and the other electrode connected to the second node N52. The switching transistor TR51 is turned on by the scan signal S[i] of the gate-on voltage Von to connect the first node N51 and the second node N52.

The driving transistor TR52 includes the gate electrode connected to the third node N53, one electrode connected to the first power source voltage ELVDD, and the other electrode connected to the fourth node N54. The driving transistor TR52 is turned on/off by the voltage of the third node N53 to control the driving current supplied to the OLED.

The compensation transistor TR53 includes the gate electrode applied with the compensation control signal GC, one electrode connected to the third node N53, and the other electrode connected to the fourth node N54. The compensation transistor TR53 is turned on by the compensation control signal GC of the gate-on voltage to connect the gate electrode and the other electrode of the driving transistor TR52.

The initialization transistor TR54 includes the gate electrode applied with the initialization signal SUS, one electrode connected to the reference voltage Vref, and the other electrode connected to the second node N52. The initialization transistor TR54 is turned on by the initialization signal SUS of the gate-on voltage to transmit the reference voltage Vref to the second node N52.

The first capacitor C51 includes one electrode connected to the data line Dj and the other electrode connected to the first node N51.

The second capacitor C52 includes one electrode connected to the second node N52 and the other electrode connected to the third node N53.

The OLED includes the anode connected to the fourth node N54 and the cathode connected to the second power source voltage ELVSS. The organic light emitting diode OLED emits light of one of primary colors. An example of the primary colors may include three primary colors such as red, green, and blue, and a desired color may be displayed by a spatial sum or a temporal sum of the three primary colors.

Figure 13:
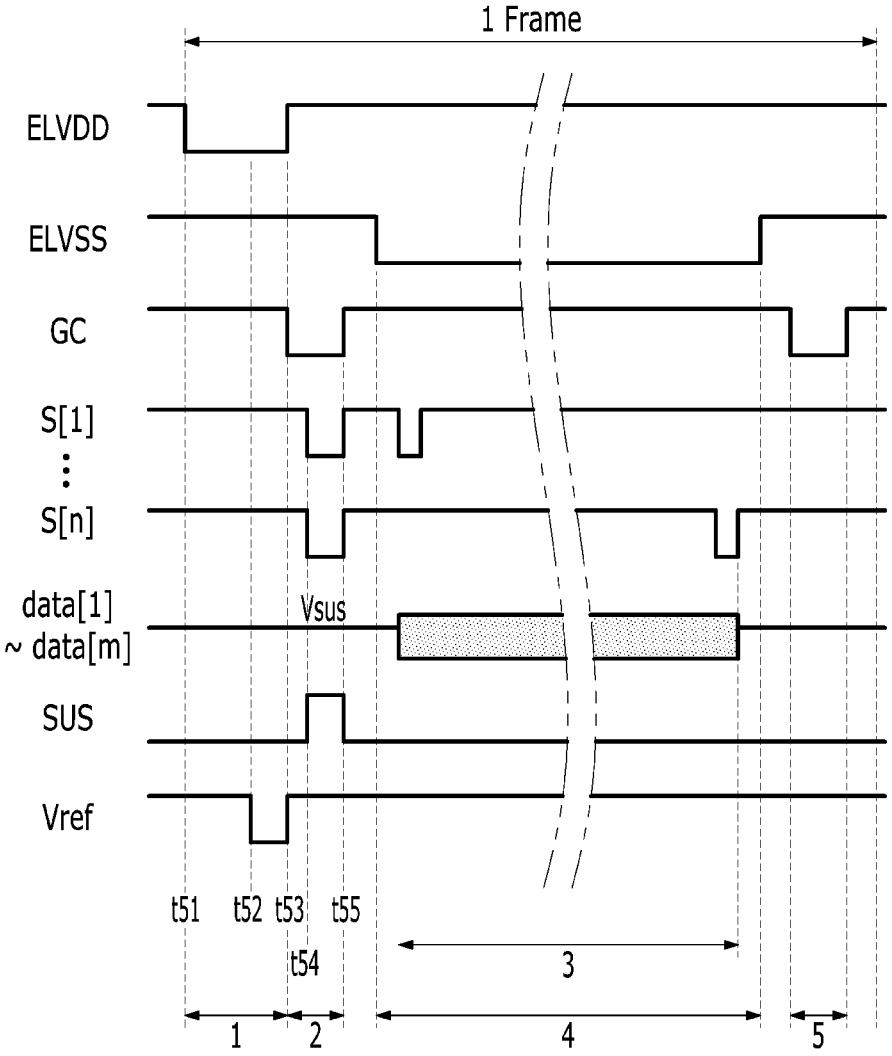
FIG. 13 is a timing diagram of a driving method of a display device according to another exemplary embodiment of the disclosed technology.

FIG. 13 is a timing diagram of a driving method of a display device according to another exemplary embodiment of the disclosed technology.

Referring to FIG. 12 and FIG. 13, a method for driving a display device including the pixel 60 of FIG. 12 according to the first exemplary embodiment will be described.

During one frame, the first power source voltage ELVDD, the second power source voltage ELVSS, the scan signals S[1]-S[n], the compensation control signal GC, the initialization signal SUS, the data signals data[1]-data[m], and the reference voltage Vref are changed according to each of the initialization period 1, the compensation period 2, the scan period 3, the light emitting period 4, and the bias period 5.

In the time t51 of the initialization period 1, the initialization signal SUS is applied as the low level voltage, and the first power source voltage ELVDD is applied as the low level voltage. The initialization transistor TR54 is turned on by the initialization signal SUS, and the reference voltage Vref is transmitted to the second node N52 through the turned-on initialization transistor TR54. At this time, the reference voltage Vref is the high level voltage and the voltage of the second node N52 becomes the high level voltage.

In the time t52 of the initialization period 1, the initialization signal SUS and the first power source voltage ELVDD maintain the low level voltage, and the reference voltage Vref is changed into the low level voltage. The reference voltage Vref of the low level voltage is transmitted to the second node N52. The voltage of the second node N52 becomes the low level voltage and the voltage of the third node N53 is decreased according to the coupling by the second capacitor C52. The voltage of the third node N53 is a low voltage for turn-on of the driving transistor TR52 as a sufficiently low voltage. The current flows from the fourth node N54 to the first power source voltage ELVDD through the driving transistor TR52 such that the voltage of the fourth node N54 is decreased. Accordingly, the anode voltage of the OLED (OLED) is reset as the low level voltage.

In the time t53 of the compensation period 2, the first power source voltage ELVDD and the reference voltage Vref are changed into the high level voltage, and the compensation control signal GC is applied as the low level voltage. The compensation transistor TR53 is turned on by the compensation control signal GC to diode-connect the driving transistor TR52. The voltage of the third node N53 becomes ELVDD+Vth. Here, ELVDD means the high level voltage of the first power source voltage ELVDD, and Vth means the threshold voltage of the driving transistor TR52. At this time, the initialization signal SUS is applied as the low level voltage, and the initialization transistor TR54 is in the turn-on state. The reference voltage Vref of the high level is transmitted to the second node N52 through the turned-on initialization transistor TR54, and the voltage of the second node N52 becomes the reference voltage Vref. The reference voltage Vref of the high level may be the same voltage as the first power source voltage ELVDD of the high level (ELVDD=Vref). Hereafter, it is assumed that the reference voltage Vref of the high level may be the same voltage as the first power source voltage ELVDD of the high level.

In the time t54 of the compensation period 2, a plurality of scan signals S[1]-S[n] are applied as the low level voltage, and the initialization signal SUS is applied as the high level voltage. As the initialization signal SUS is applied as the high level voltage, the initialization transistor TR54 is turned off. As a plurality of scan signals S[1]-S[n] are applied as the low level voltage, the switching transistor TR51 is turned on, and the first node N51 and the second node N52 are connected. At this time, the data signal data[j] is applied as the sustain voltage Vsus. The voltage stored in the first capacitor C51 is a voltage stored in the first capacitor 51 during the scan period 3 of the previous frame of the current frame, and is Vref-data. The description thereof is given later in the description for the scan period 3. Data means a voltage of the data signals data[1] to data[m]. In the state that the sustain voltage Vsus is applied to the data line Dj, as the switching transistor TR51 is turned on, the voltage of the second node N52 is changed by the voltage stored to the first capacitor C51. The voltage Vd of the second node N52 is changed as shown in Equation 1 described in FIG. 4.

In a time t55 of the compensation period 2, the compensation control signal GC and a plurality of scan signals S[1]-S[n] are applied as the high level voltage and the initialization signal SUS is applied as the low level voltage. The switching transistor TR51 and the compensation transistor TR53 are turned off. The initialization transistor TR14 is turned on by the initialization signal SUS, and the reference voltage Vref of the high level voltage is transmitted to the second node N52. As the voltage of the second node N52 is changed into the reference voltage Vref of the high level, the voltage Vg of the third node N13 is changed by the coupling according to the second capacitor C52. If the reference voltage Vref of the high level voltage is the same voltage as the first power source voltage ELVDD of the high level (Vref=ELVDD), the voltage Vg of the third node N53 is changed as shown in Equation 2 described in FIG. 4.

In the light emitting period 4, the first power source voltage ELVDD maintains the high level voltage, and the second power source voltage ELVSS is changed into the low level voltage. As the second power source voltage ELVSS is changed into the low level voltage, the current flows to the OLED through the driving transistor TR52. The driving current I_OLED flowing to the organic light emitting diode OLED is as shown in Equation 3 described in FIG. 4.

In the scan period 3, a plurality of scan signals S[1]-S[n] are sequentially applied as the low level voltage to turn on the switching transistor TR51, and a plurality of data signals data[1]-data[m] are applied corresponding to a plurality of scan signals S[1]-S[n]. At this time, the initialization signal SUS is applied as the low level voltage, and the initialization transistor TR54 is in the turned-on state. The reference voltage Vref of the high level voltage is transmitted to the second node N52. If the switching transistor TR51 is turned on, the reference voltage Vref of the high level voltage is transmitted to the first node N51. Accordingly, the first capacitor C51 stores the voltage of Vref-data. That is, the data is programmed to a plurality of pixels. The voltage of Vref-data stored to the first capacitor C1 is used to the light emitting period 4 of the next frame.

In the bias period 5, the first power source voltage ELVDD and the second power source voltage ELVSS are applied as the high level voltage and the compensation control signal GC is applied as the low level voltage. The compensation transistor TR53 is turned on by the compensation control signal GC, and the third node N53 and the fourth node N54 are connected such that the voltage of the third node N53 and the fourth node N54 is reset into a predetermined voltage. After the compensation control signal GC is changed into the high level voltage such that the transistor TR53 is turned-off, the reference voltage Vref is changed into the low level voltage. The initialization signal SUS is in the state that it is applied as the low level voltage such that the reference voltage Vref of the low level is transmitted to the second node N52. The voltage of the second node N52 is changed into the low level voltage, and the voltage of the third node N53 is also changed into the low level voltage by the coupling of the second capacitor C52. The voltage of the gate, source, and drain of the driving transistor TR52 is reset into a predetermined voltage and a response waveform of the pixel may be improved. The bias period 5 may be omitted.

Figure 14:
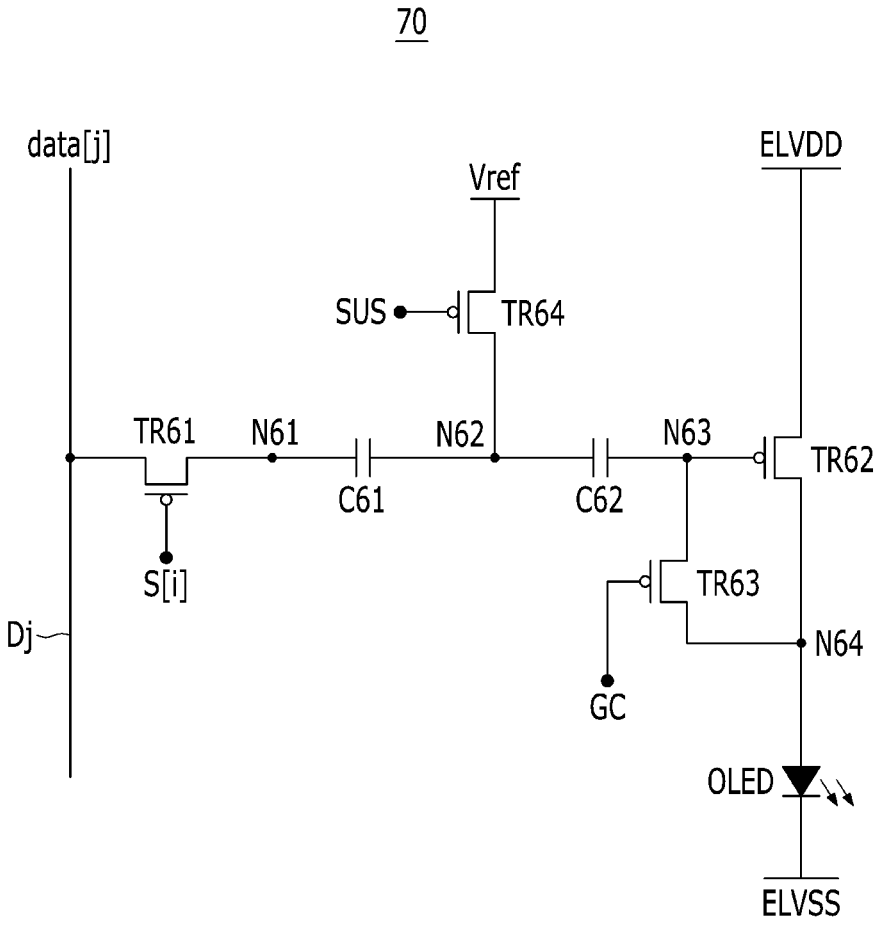
FIG. 14 is a circuit diagram of a pixel according to another exemplary embodiment of the disclosed technology.

FIG. 14 is a circuit diagram of a pixel according to another exemplary embodiment of the disclosed technology.

Referring to FIG. 14, the pixel 70 includes a switching transistor TR61, a driving transistor TR62, a compensation transistor TR63, an initialization transistor TR64, a first capacitor C61, a second capacitor C62, and an organic light emitting diode (OLED).

As a difference from the pixel 60 of FIG. 12, the positions of the switching transistor TR61 and the first capacitor C61 are exchanged.

The switching transistor TR61 includes the gate electrode applied with the scan signal Sk1, one electrode connected to the data line Dj, and the other electrode connected to the first node N61. The switching transistor TR61 is turned on by the scan signal S[i] of the gate-on voltage Von to transmit the voltage of the data line Dj to the first node N61.

The first capacitor C61 includes one electrode connected to the first node N61 and the other electrode connected to the second node N62.

The other constituent elements of the pixel 70 of FIG. 14 are the same as those of the pixel 60 of FIG. 12 and are not described in further detail.

Also, the driving timing diagram of the display device including the pixel 70 of FIG. 14 is the same as that of FIG. 13.

However, in the time t54 of the compensation period 2, as the switching transistor TR61 is turned on, the data line Dj and the first node N61 are connected. At this time, the data signal data[j] is applied as the sustain voltage Vsus and the voltage Vd of the second node N62 is equally changed as shown in Equation 1 of FIG. 4.

Also, in the scan period 3, as the switching transistor TR61 is turned on, the data voltage data is transmitted to the first node N61 and the reference voltage Vref is transmitted to the second node N62 through the turned-on initialization transistor TR64, however the first capacitor C61 equally stores the voltage Vref-data.

The operation of the display device including the pixel 70 of FIG. 14 is the same as that of the operation in FIG. 13 and is not described in further detail.

The drawings referred to in the above and disclosed detailed description of the present invention only illustrate the present invention, and are intended to describe the present invention, not to restrict the meanings or limit the scope of the present invention claimed in the claims. Therefore, those skilled in the art can understand that various modifications and other equivalent exemplary embodiment may be made therefrom. Accordingly, the true technical protection scope of the present invention must be determined by the technical spirit of the accompanying claims.

What is claimed is:

1. An organic light emitting diode (OLED) display device, comprising:

a plurality of pixels, each pixel comprising a first capacitor connected between a data line and a first node, a first switching transistor directly connecting the first node and a second node, a second capacitor directly connected between the second node and a third node, a driving transistor having a gate terminal directly connected to the third node and configured to control a driving current flowing from a first power source voltage to an organic light emitting diode (OLED), and a reference voltage transistor configured to transmit a reference voltage to the first node, wherein, when a light emitting step in which the OLED emits light is simultaneously performed in a plurality of pixels by a driving current, the first switching transistor is turned off and the reference voltage transistor is turned on such that the reference voltage is transmitted to the first node, and a data voltage corresponding to at least a portion of the pixels is stored in the first capacitor, and wherein the first switching transistor is configured to be turned on by a compensation control signal of a gate-on voltage so as to connect the first node and the second node.

2. The display device of claim 1, wherein each pixel further comprises a second switching transistor configured to be turned on by a scan signal of the gate-on voltage to connect the data line to the first capacitor.

3. The display device of claim 2, wherein the reference voltage transistor is configured to be turned on by an initialization signal of the gate-on voltage so as to transmit the reference voltage to the first node.

4. The display device of claim 2, wherein at least one of the first switching transistor, the driving transistor, the reference voltage transistor, an initialization transistor, the compensation transistor, and the second switching transistor is an oxide thin film transistor (TFT).

5. A method of driving a display device comprising a plurality of pixels, each pixel comprising a first capacitor directly connected between a data line and a first node, a switching transistor directly connecting the first node and a second node, a second capacitor directly connected between the second node and a third node, a driving transistor having a gate terminal directly connected to the third node and configured to control a driving current flowing from a first power source voltage to an organic light emitting diode (OLED), and a reference voltage transistor configured to transmit a reference voltage to the first node, the method comprising:

a scan step in which the switching transistor is turned off and the reference voltage transistor is turned on in a scan period of a first frame such that the reference voltage is transmitted to the first node and a data voltage applied to the data line is stored in the first capacitor; and a light emitting step in which the OLED emits light according to a driving current flowing to the driving transistor by a voltage stored in the second capacitor in a light emitting period of the first frame, wherein the voltage stored in the second capacitor depends on the voltage stored in the first capacitor in the scan period of a frame immediately preceding the first frame, and each light emitting step of a plurality of light emitting steps of a plurality of pixels is simultaneously performed, and the scan step and the light emitting step are temporally overlapped with each other, and wherein the scan step further comprises:

a step in which a scan signal of a gate-on voltage is applied to the gate terminal of a second switching transistor connecting the data line and the first capacitor; and a step in which the data voltage corresponding to the scan signal of the gate-on voltage is applied to the data line to be stored in the first capacitor.

6. The method of claim 5, wherein the scan step further comprises:

a step in which a compensation control signal of a gate-off voltage is applied to a gate terminal of a compensation transistor connecting the gate terminal of the driving transistor and an anode of the organic light emitting diode (OLED); and a step in which the compensation control signal of the gate-off voltage is applied to the gate terminal of the switching transistor.

7. An organic light emitting diode (OLED) pixel, comprising:

a first capacitor including one electrode connected to a data line and other electrode directly connected to a first node;

a first switching transistor including a gate terminal, one of a source or drain terminal directly connected to the first node, and the other of the source or drain terminal directly connected to a second node;

a second capacitor including one electrode directly connected to the second node and the other electrode directly connected to a third node;

a driving transistor including a gate terminal directly connected to the third node, one of a source or drain terminal directly connected to a first power source voltage, and the other of the source or drain terminal directly connected to an anode of an organic light emitting diode (OLED); and a reference voltage transistor including a gate terminal, one of a source or drain terminal directly connected to a reference voltage, and the other of the source or drain terminal directly connected to the first node, wherein an initialization signal is applied to the gate terminal of the reference voltage transistor.

8. The pixel of claim 7, wherein a compensation control signal is applied to the gate terminal of the first switching transistor.

9. The pixel of claim 7, further comprising a second switching transistor including a gate terminal configured to be applied with a scan signal, one of a source or drain terminal directly connected to the data line, and the other of the source or drain terminal directly connected to one electrode of the first capacitor.

10. The pixel of claim 9, wherein a relay signal is applied to the gate terminal of the first switching transistor.

11. The pixel of claim 10, wherein a compensation control signal is applied to the gate terminal of the first switching transistor.

12. An organic light emitting diode (OLED) pixel, comprising:

a first capacitor including one electrode directly connected to a data line and other electrode directly connected to a first node;

a switching transistor including a gate terminal configured to be applied with a scan signal, one of a source or drain terminal directly connected to the first node, and other of the source or drain terminal directly connected to a second node;

a second capacitor including one electrode directly connected to the second node and the other electrode directly connected to a third node;

a driving transistor including a gate terminal directly connected to the third node, one of a source or drain terminal directly connected to a first power source voltage, and the other of the source of drain terminal directly connected to an anode of an organic light emitting diode (OLED);

a compensation transistor including a gate terminal applied with a compensation control signal, one of a source or drain terminal directly connected to the third node, and the other of the source or drain directly connected to the anode of the OLED; and a reference voltage transistor including a gate terminal configured to be applied with an initialization signal, one of a source or drain terminal directly connected to a reference voltage, and the other of the source or drain terminal directly connected to the second node.

13. An organic light emitting diode (OLED) pixel, comprising:

a switching transistor including a gate terminal applied with a scan signal, one of a source or drain terminal directly connected to a data line, and other of the source or drain terminal directly connected to a first node;

a first capacitor including one electrode directly connected to the first node and the other electrode directly connected to a second node;

a second capacitor including one electrode directly connected to the second node and the other electrode directly connected to a third node;

a driving transistor including a gate terminal directly connected to the third node, one of a source or drain terminal directly connected to a first power source voltage, and the other of the source or drain terminal directly connected to an anode of an organic light emitting diode (OLED);

a compensation transistor including a gate terminal configured to be applied with a compensation control signal, one of a source or drain terminal directly connected to the third node, and the other of the source or drain terminal directly connected to the anode of the OLED; and a reference voltage transistor including a gate terminal configured to be applied with an initialization signal, one of a source or drain terminal directly connected to a reference voltage, and the other of the source or drain terminal directly connected to the second node.

* * * * *